US008221235B2

(12) United States Patent
Goto et al.

(10) Patent No.: US 8,221,235 B2
(45) Date of Patent: Jul. 17, 2012

(54) DRAWING MACHINE AND GAME APPARATUS USING THE SAME

(75) Inventors: Nobuhiro Goto, Tokyo (JP); Kazuhiro Kusuda, Tokyo (JP); Daisuke Sato, Tokyo (JP); Shingo Yasuda, Kanagawa (JP); Yuichi Nakahara, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 1014 days.

(21) Appl. No.: 12/084,328

(22) PCT Filed: Oct. 27, 2006

(86) PCT No.: PCT/JP2006/321478
§ 371 (c)(1),
(2), (4) Date: Aug. 7, 2008

(87) PCT Pub. No.: WO2007/052546
PCT Pub. Date: May 10, 2007

(65) Prior Publication Data

US 2009/0247260 A1 Oct. 1, 2009

(30) Foreign Application Priority Data

Oct. 31, 2005 (JP) ..... 2005-317494

(51) Int. Cl.
*A63F 9/24* (2006.01)

(52) U.S. Cl. ..... 463/32; 463/30; 463/31; 463/33

(58) Field of Classification Search ..... 463/16–20, 463/30–33
See application file for complete search history.

(56) References Cited

U.S. PATENT DOCUMENTS 5,938,200 A * 8/1999 Markowicz et al. ..... 273/246
(Continued)

FOREIGN PATENT DOCUMENTS

CN 1300990 A 6/2001
(Continued)

OTHER PUBLICATIONS

Chinese Office Action for corresponding CN Application No. 2006800404456, Oct. 23, 2009.
(Continued)

*Primary Examiner* — Peter DungBa Vo
*Assistant Examiner* — Steve Rowland
(74) *Attorney, Agent, or Firm* — Ditthavong Mori & Steiner, P.C.

(57) ABSTRACT

The present invention provides a drawing machine and a game apparatus using the same by which it is easier to give the participants of the drawing an impression like drawing is carried out fairly when the computer drawing in which a winning-probability of each of drawing-objects is changed is carried out.

A drawing machine for determining a winning-object from a plurality of drawing-objects includes: a winning-probability data storage unit for storing winning-probability data showing respective winning-probabilities of the plurality of drawing-objects; a drawing unit for carrying out a drawing in accordance with the winning-probability of each of the drawing-objects determined by the winning-probability data stored in the winning-probability data storage unit and determining a winning-object from the plurality of drawing-objects; a winning-probability data changing unit for changing the winning-probability data stored in the winning-probability data storage unit; a winning-probability image displaying unit for displaying a winning-probability image showing the winning-probability of each of the drawing-objects determined by the winning-probability data stored in the winning-probability data storage unit; and a winning-probability displaying control unit for changing the winning-probability image displayed on the winning-probability image displaying unit, when the winning-probability data changing unit changes the winning-probability data, so as to correspond to the changed winning-probability data.

11 Claims, 15 Drawing Sheets

U.S. PATENT DOCUMENTS

| | | | | |
|---|---|---|---|---|
| 6,186,892 | B1 * | 2/2001 | Frank et al. | 463/19 |
| 6,280,325 | B1 * | 8/2001 | Fisk | 463/19 |
| 2004/0023715 | A1 * | 2/2004 | Luciano et al. | 463/25 |
| 2004/0251628 | A1 * | 12/2004 | Kilby | 273/269 |
| 2006/0205477 | A1 * | 9/2006 | Fisk et al. | 463/17 |

FOREIGN PATENT DOCUMENTS

| | | | | |
|---|---|---|---|---|
| JP | 06-19944 | A | | 1/1994 |
| JP | 06-077783 | U | | 11/1994 |
| JP | 07-012190 | U | | 2/1995 |
| JP | 11-177941 | A | | 7/1999 |
| JP | 2001-161889 | A | | 6/2001 |
| JP | 2002-248265 | A | | 9/2002 |
| JP | 3097086 | U | | 1/2004 |
| JP | 2004-57660 | A | | 2/2004 |
| JP | 2004057660 | A | * | 2/2004 |
| JP | 2005-046512 | A | | 2/2005 |
| JP | 2005-052491 | A | | 3/2005 |
| JP | 2006-340818 | A | | 12/2006 |
| TW | 548120 | B | | 8/2003 |

OTHER PUBLICATIONS

Korean Office Action for corresponding KR Application No. 10-2008-7006770, Dec. 15, 2009.

Office Action of Patent Appplication No. 2005-317494 mailed on Jan. 5, 2007 (Japan).

Office Action of Patent Appplication No. 2005-317494 mailed on Jun. 8, 2007(Japan).

International Search Report of International Application No. PCT/JP2006/321478 mailed on Jan. 9, 2007.

Written Opinion of the International Searching Authority mailed on Jan. 9, 2007.

* cited by examiner

[FIG. 1A]
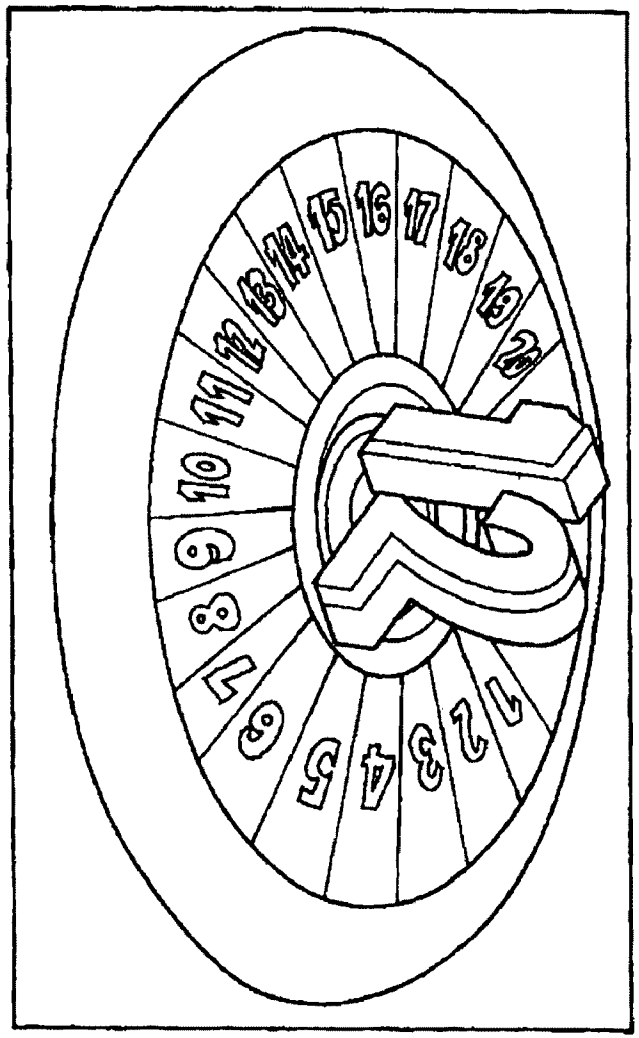

[FIG. 1B]
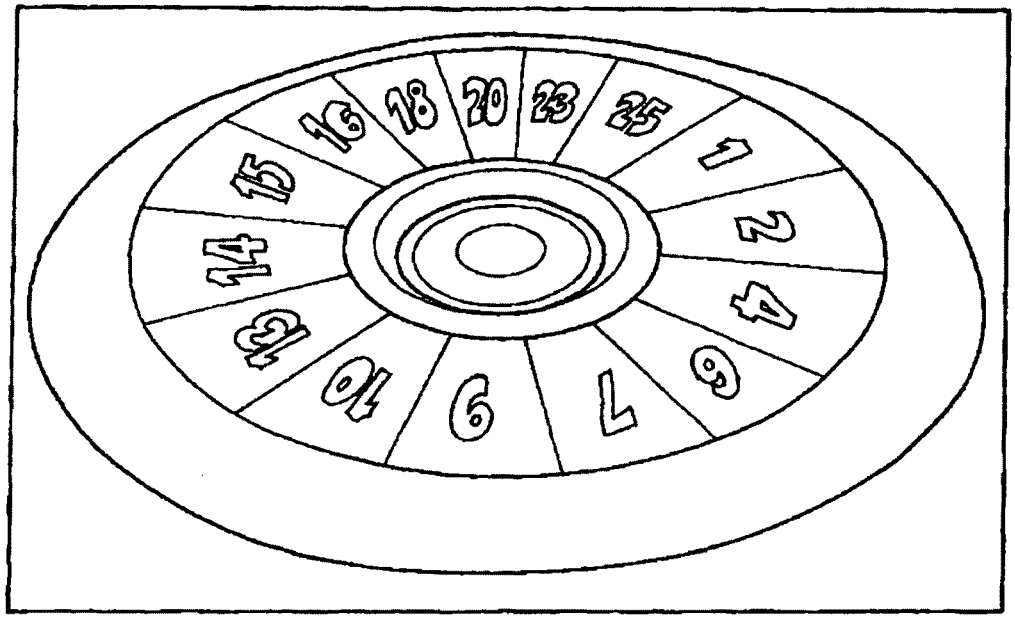

[FIG. 2]
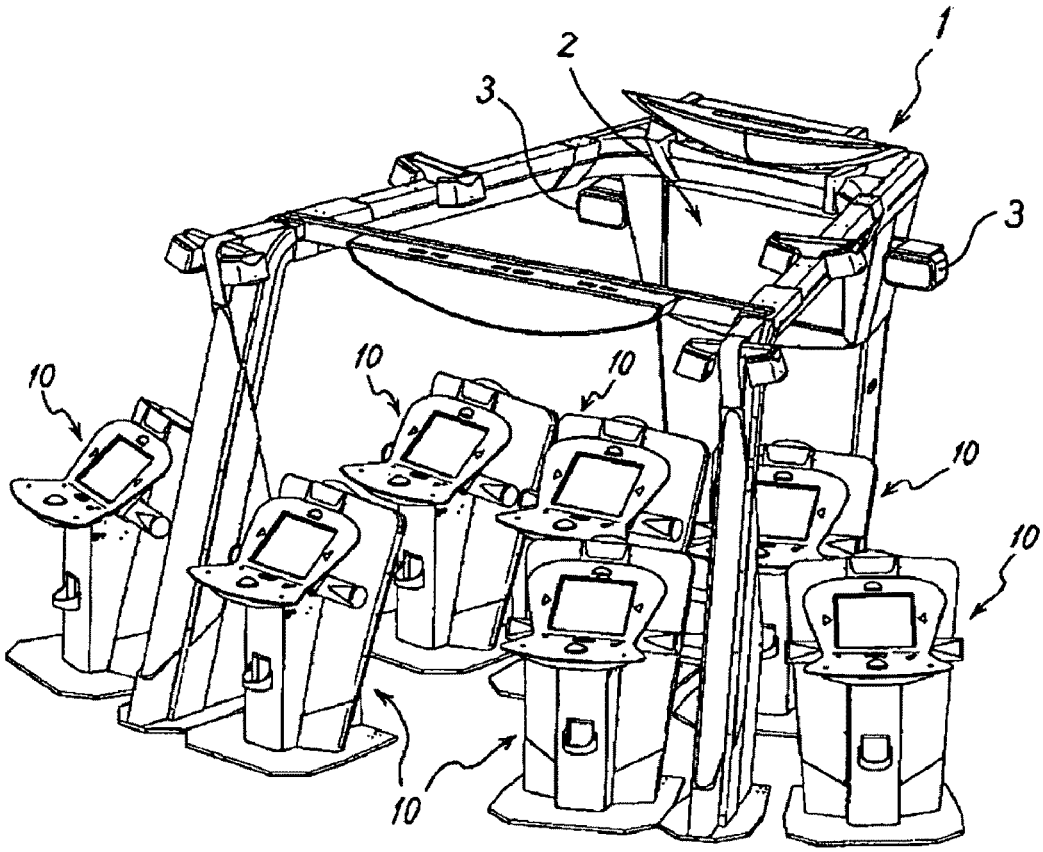

[FIG. 3]
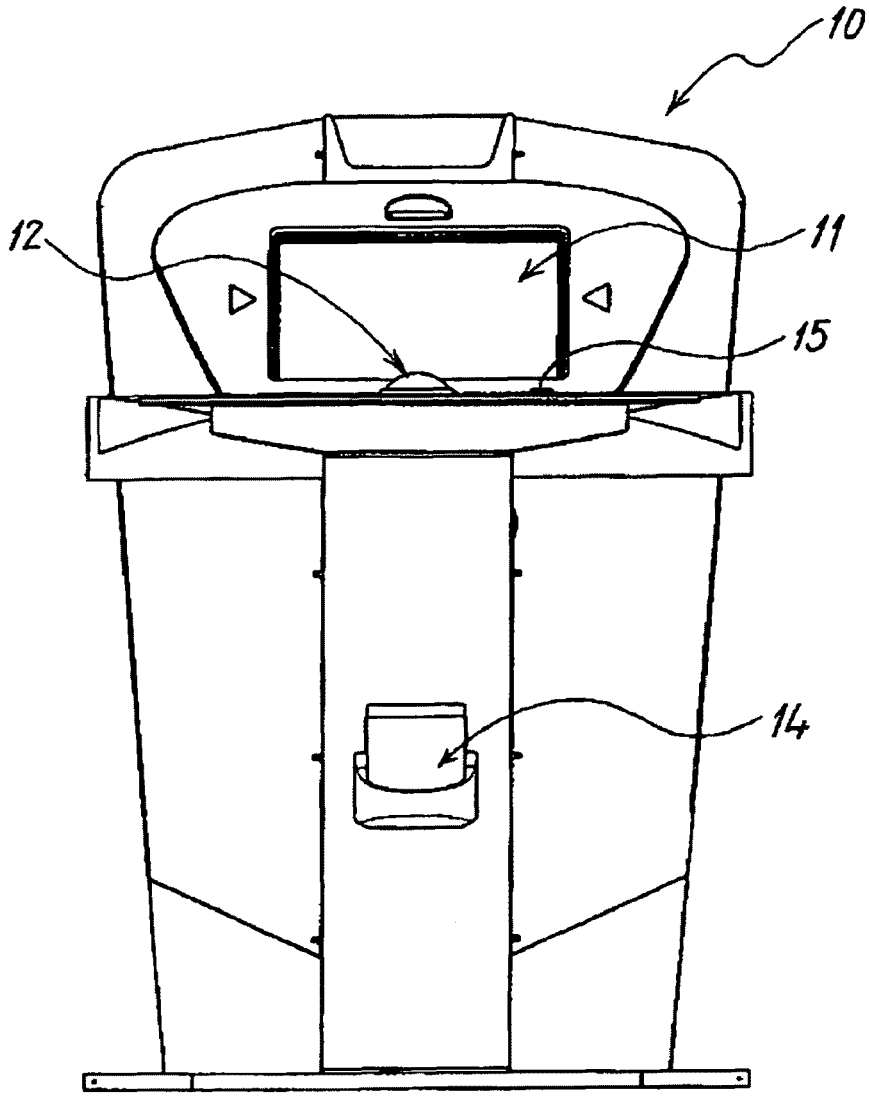

[FIG. 4]
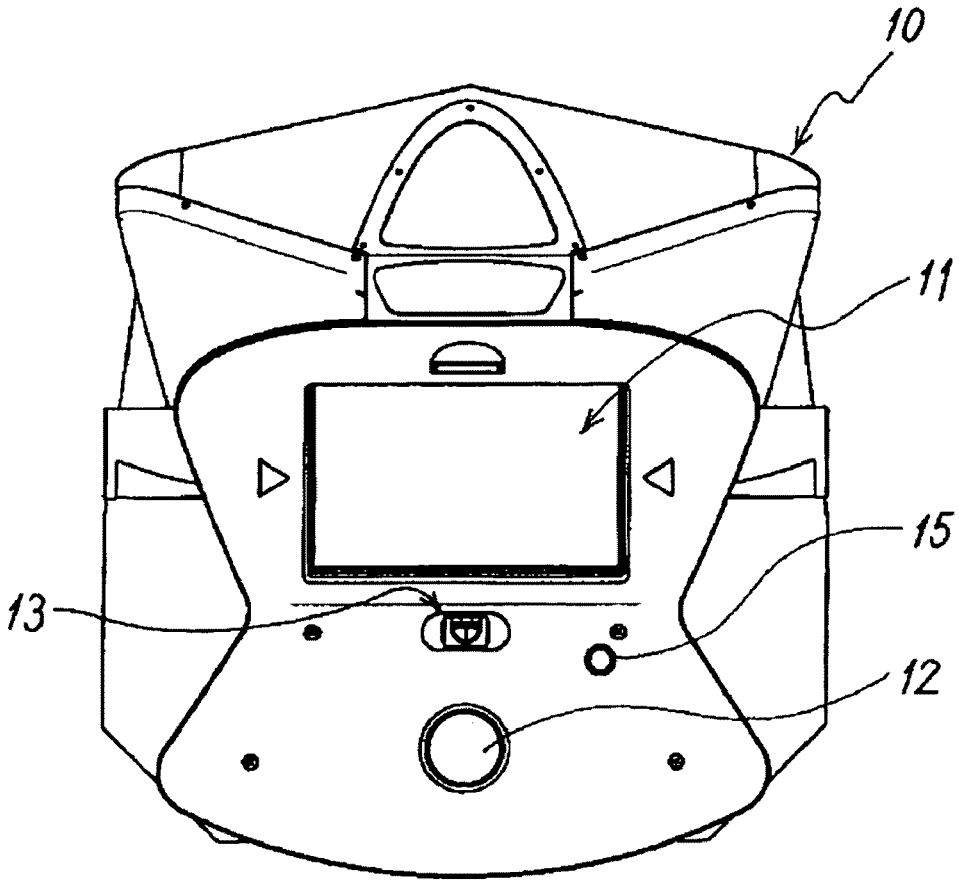

[FIG. 5]
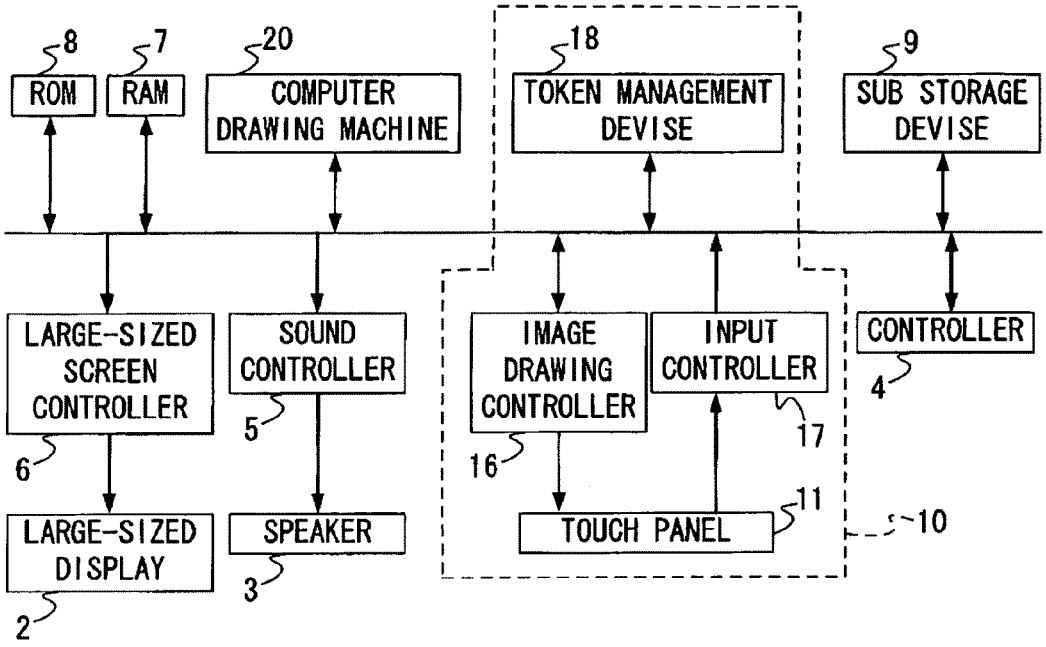

[FIG. 6]
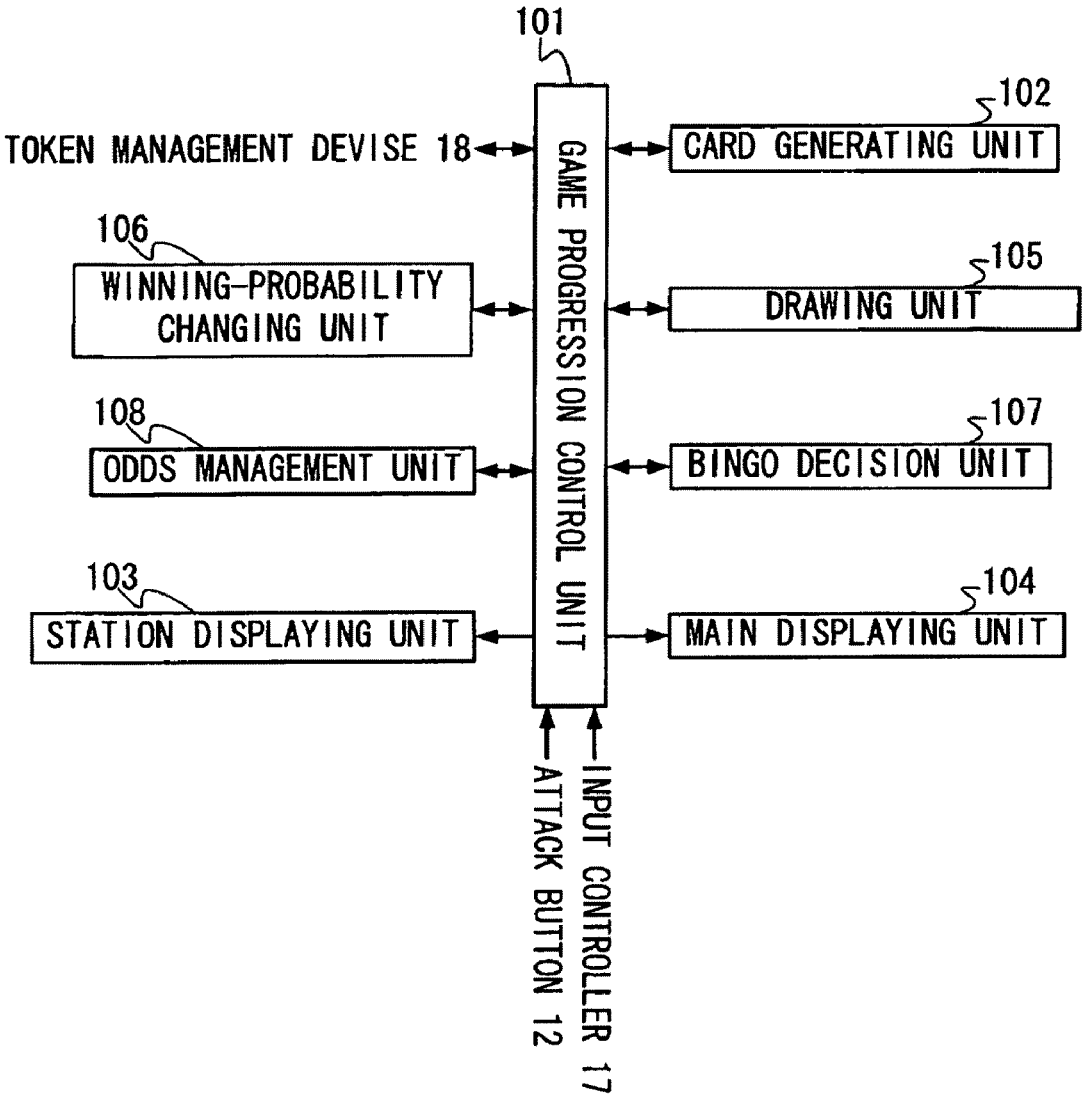

[FIG. 7]
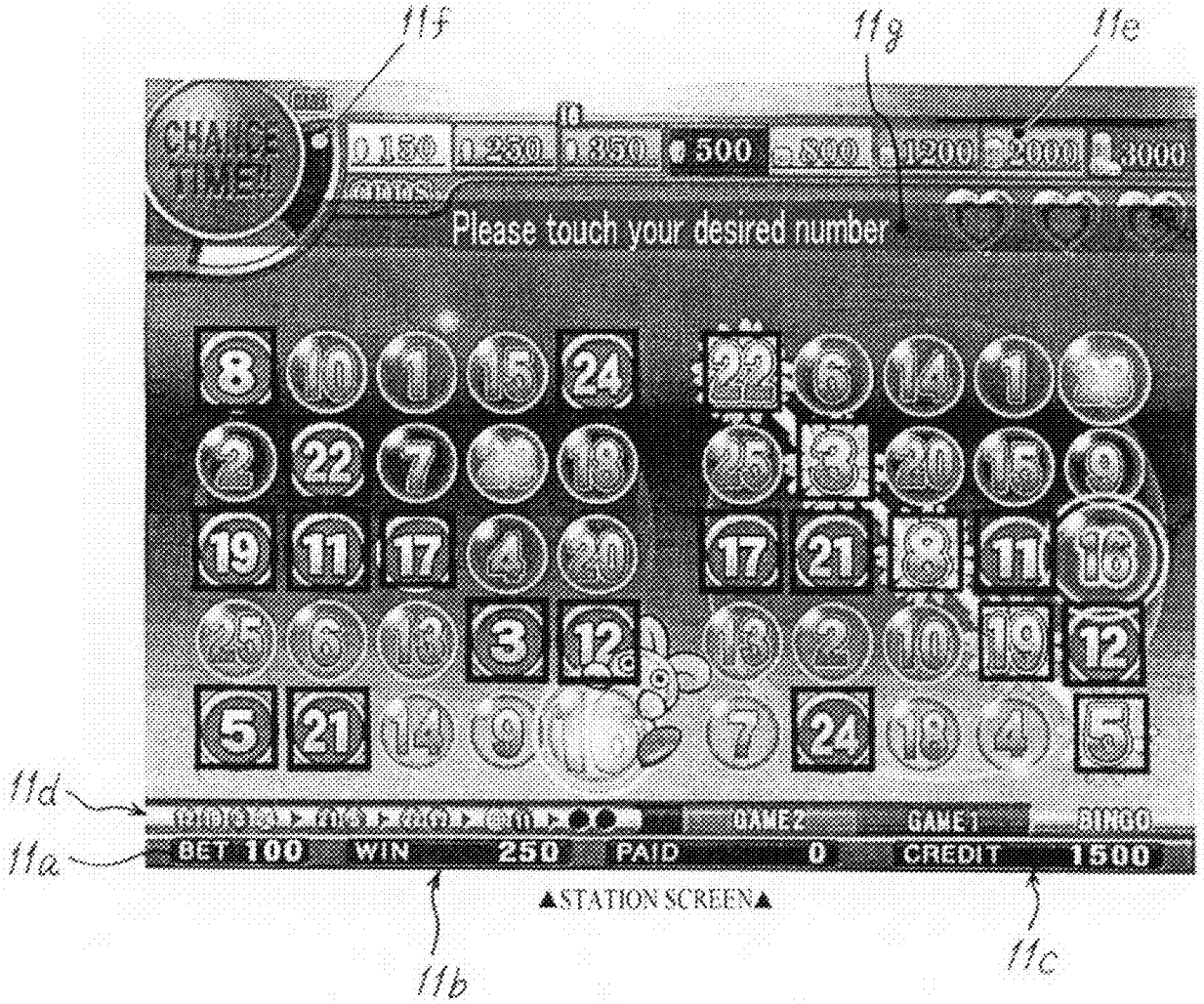

[FIG. 8]
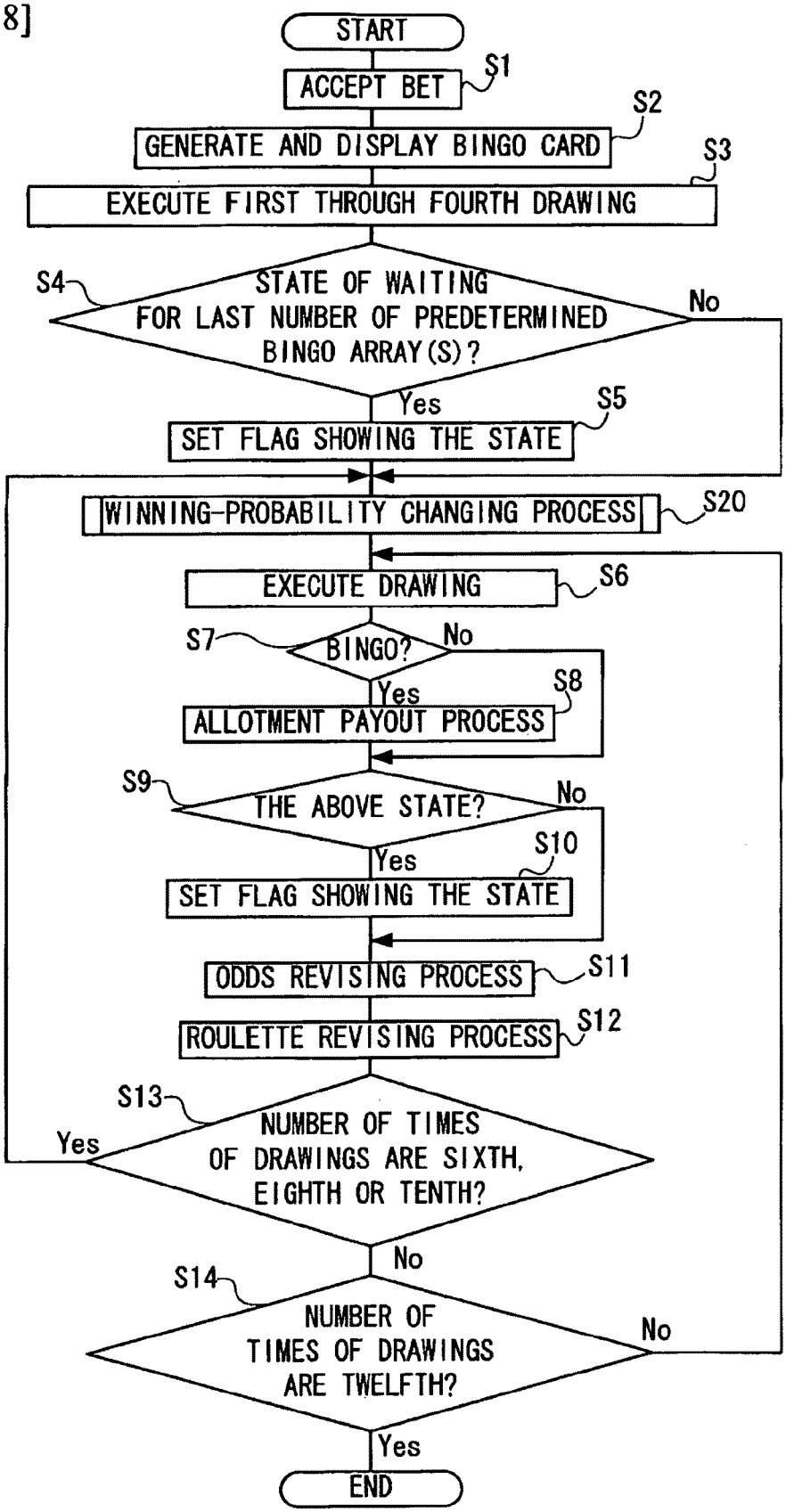

[FIG. 9]
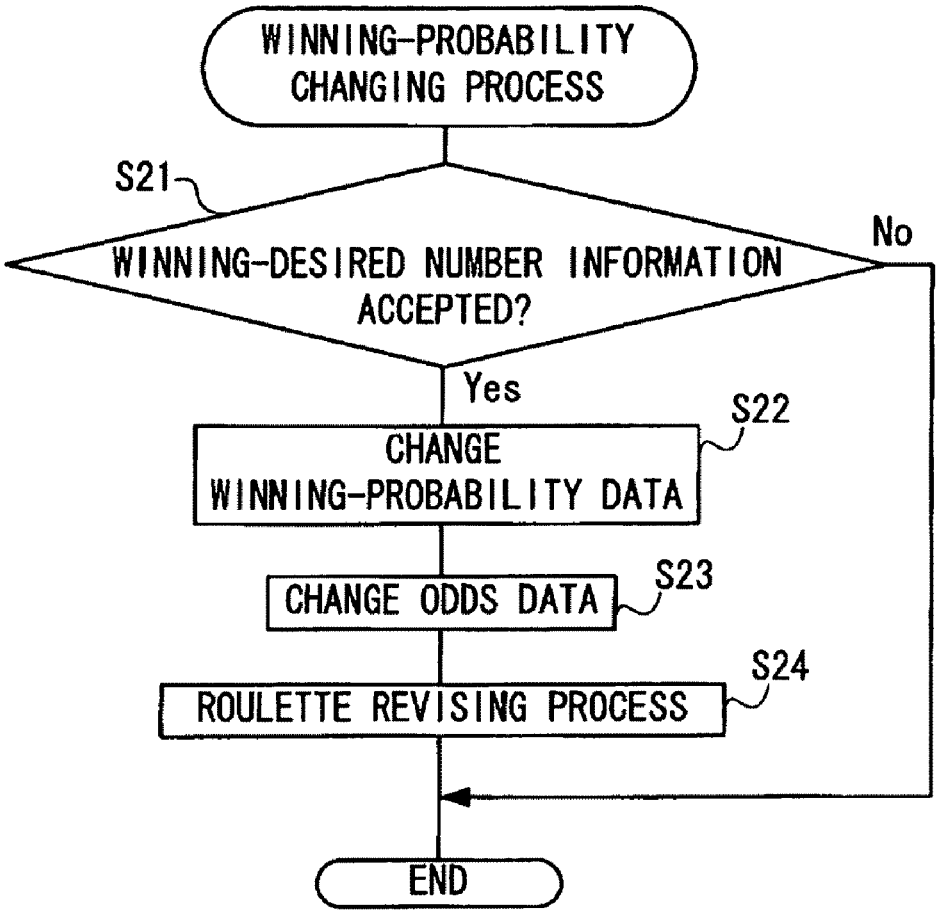

[FIG. 10]
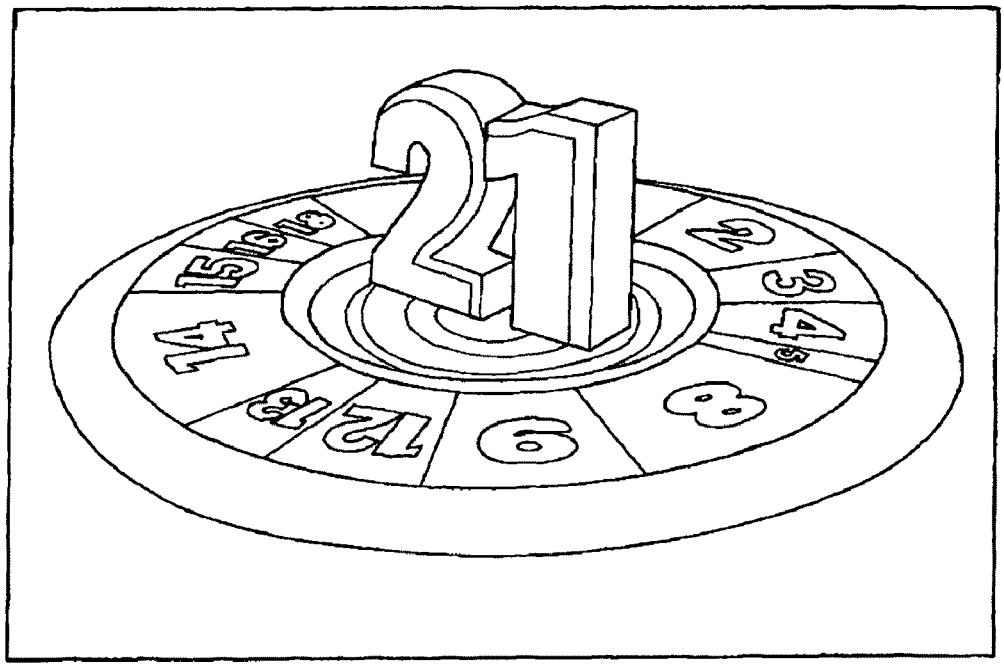

[FIG. 11]
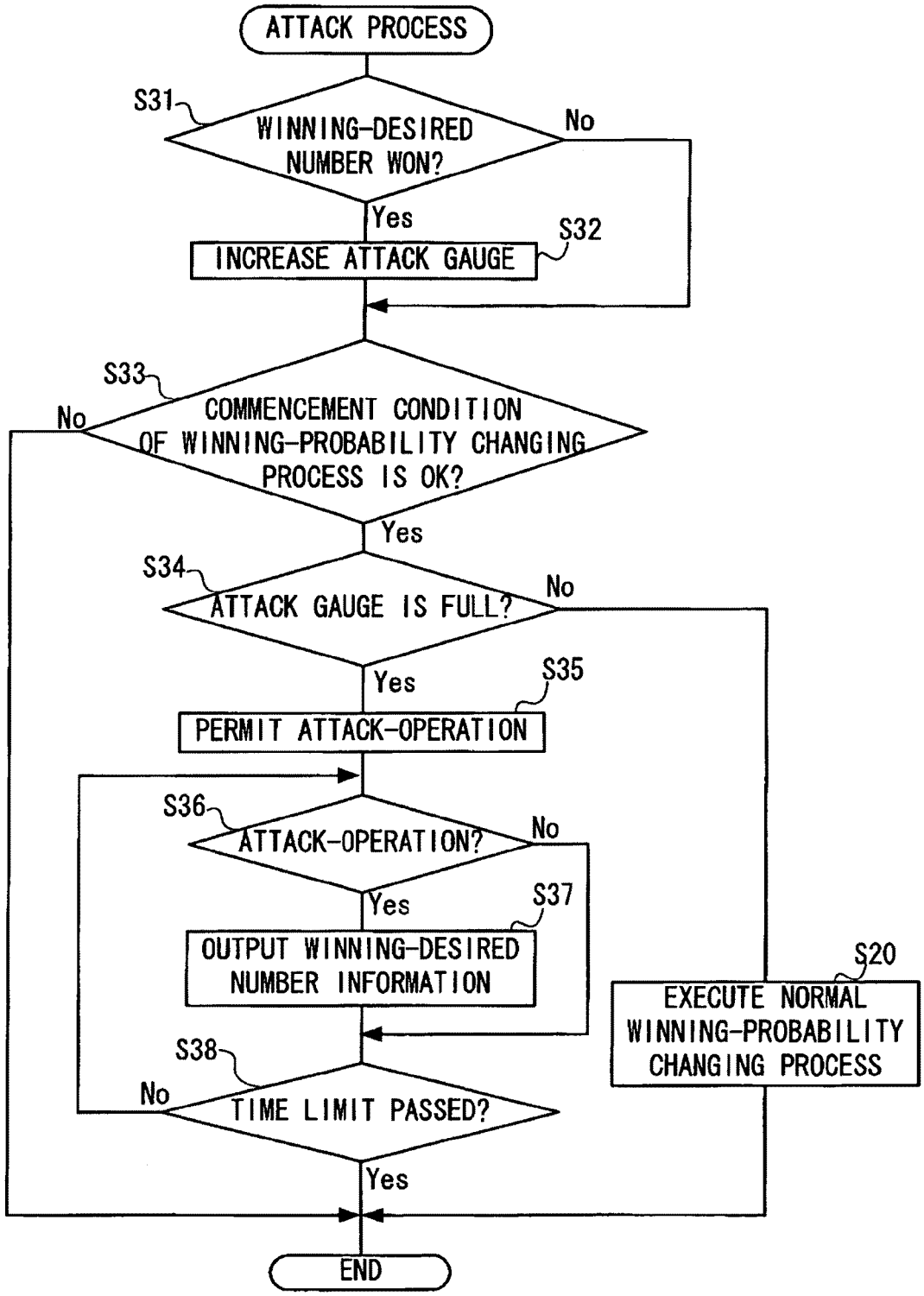

[FIG. 12]
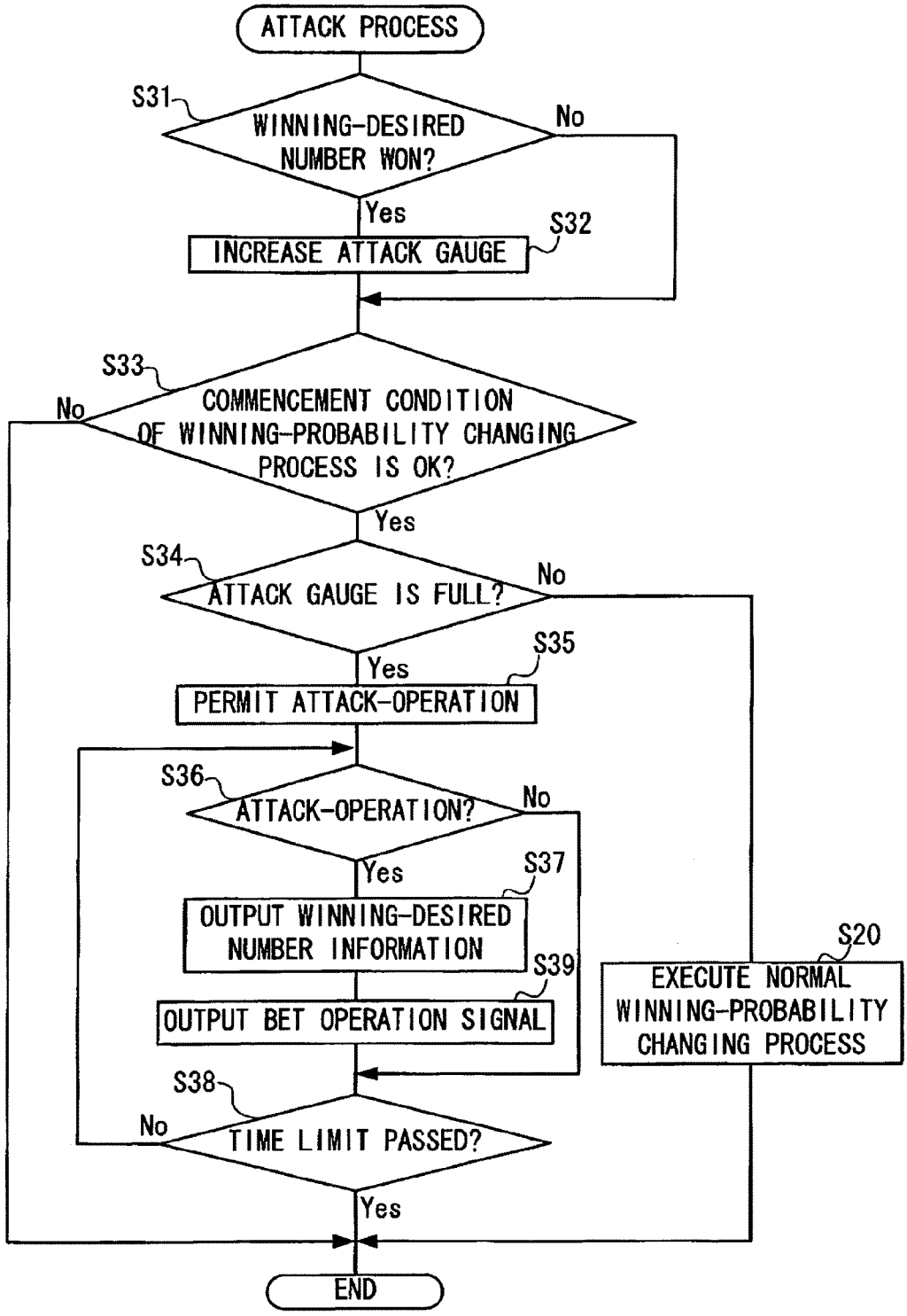

[FIG. 13]
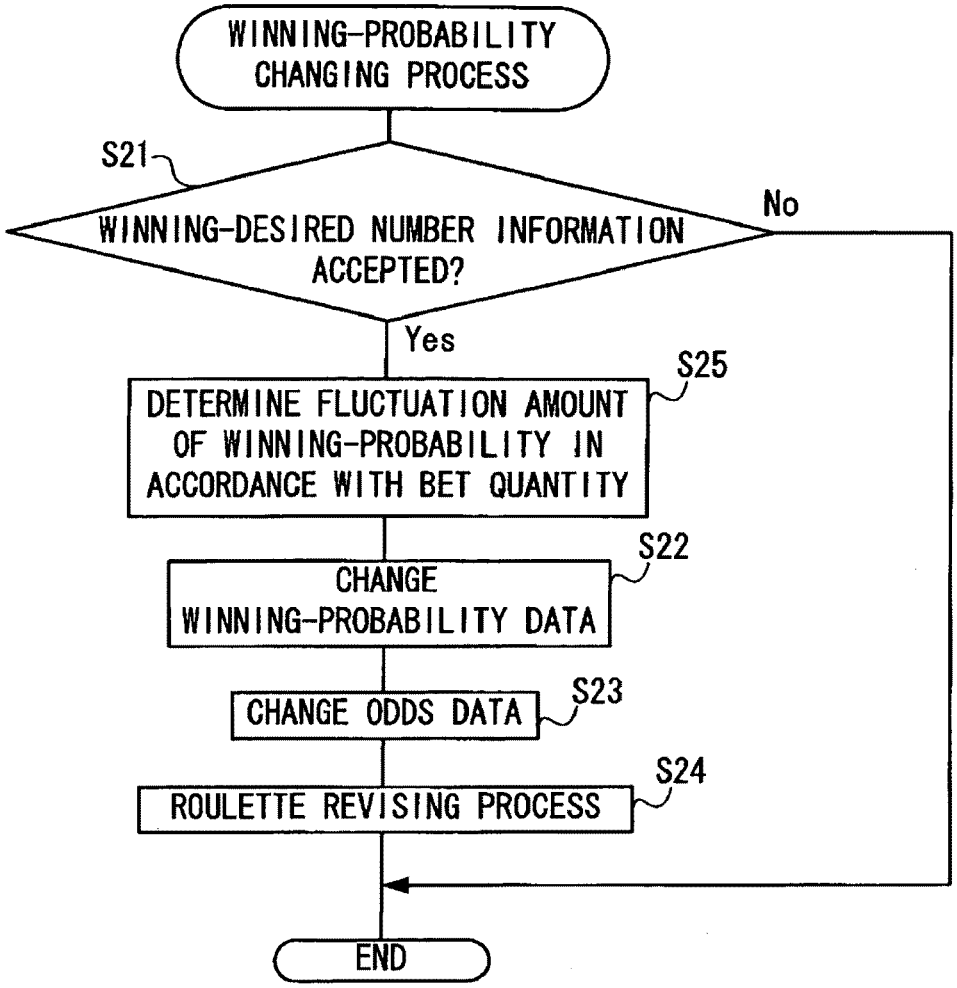

[FIG. 14]
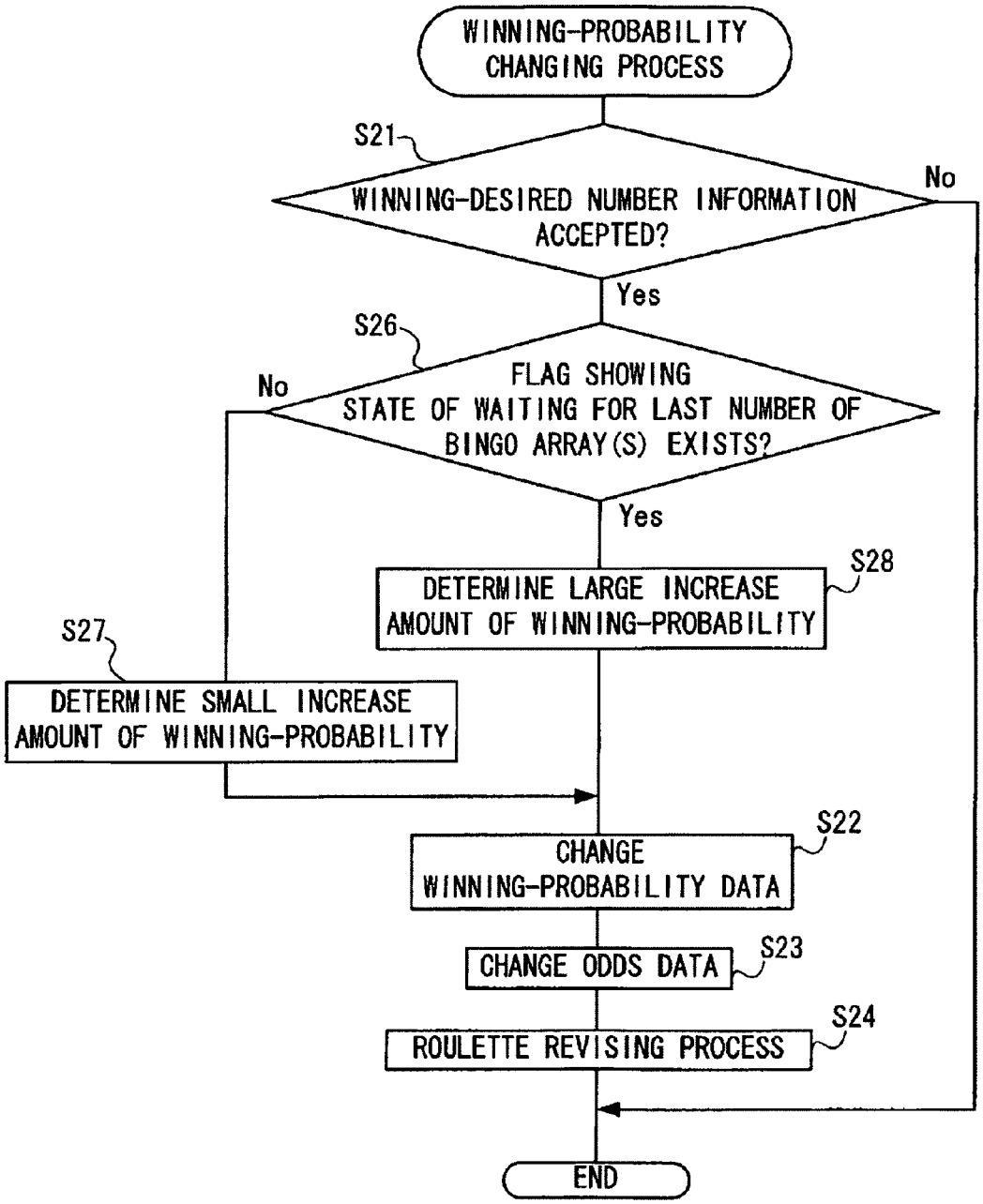

DRAWING MACHINE AND GAME APPARATUS USING THE SAME

TECHNICAL FIELD

The present invention relates to a drawing machine and a game apparatus using the same that carries out a drawing in accordance with a winning-probability of each of drawing-objects determined by the winning-probability data and determines a winning-object in a plurality of drawing-objects.

BACKGROUND ART

A drawing machine that determines a winning-object in a plurality of drawing-objects is widely utilized in a wide range of fields. For example, a bingo game machine in Patent Document 1 has been known as a game apparatus utilizing the drawing machine. With this bingo game machine, a bingo card image (an array image) arrayed in a square matrix consisting of 5 by 5 rows, in which a number image (a drawing-object image) is disposed by an array unique to each player, is displayed in a displaying unit set up for each player. After that, a winning number (winning-object) is determined from twenty-five numbers (drawing-objects) from "1" through "25" by a drawing machine, and display patterns of winning numbers and numbers other than the winning numbers are made different from each other in the bingo card images of the respective players. By repeating the above operation by a predetermined number of times, when all the numbers in any one of the longitudinal direction, the horizontal direction and the diagonal direction are drawn on the bingo card image, BINGO is established, and allotment is paid to the player.

In the drawing machine such as utilized in the bingo game machine, it is important that a participant of drawing has a impression like a drawing is carried out fairly whether or not the drawing is actually carried out fairly. Therefore, the bingo game machine described in Patent Document 1 utilizes a drawing machine carrying out so-called physical drawing. In detail, the drawing machine used in the bingo game machine is composed of a supply hole of a ball, one revolution body having a surface portion on which the ball rolls, a collecting unit provided with a plurality of pockets for collecting the ball. The revolution body is rotated on a fixed plane by a revolution driving mechanism. The revolution body makes the ball supplied from the supply hole roll irregularly on the surface portion and spring out. The twenty-four pockets are provided with a periphery of the revolution body along circumferential direction. Therefore, the ball rolling on the revolution body along circumferential direction enters into either pocket and is collected. Either of number "1" through "25" is allotted to the each pocket respectively, a number allotted to the pocket into which the ball has been entered is determined as the winning-object. According to the drawing machine carrying out thus physical drawing, since participants of drawing can understand definitely a process of the drawing, it is possible to give the participants of drawing an impression like the drawing is carried out fairly.

However, in the drawing machine carrying out thus physical drawing, there is a defect in that degree of variation when a winning-probability of each of the drawing-objects is changed is low.

That is, in an example of the drawing machine described in Patent Document 1, for example, if a size of the pockets is changed by using driving mechanism or a number allotted to the pockets is changed, it is possible to change the winning-probability of each of the drawing-objects. However, the size and the allocable number of the pocket are restricted physically. Therefore, in a restricted range, it is necessary to change the winning-probability of each of the drawing-objects, whereby a degree of variation for changing the winning-probability is low.

On the other hand, conventionally, a drawing machine carrying out so-called computer drawing has been known, by which winning-objects are determined by executing a drawing program in accordance with a winning-probability of each of drawing-objects determined by winning-probability data. In the drawing machine carrying out thus computer drawing, since the winning-probability of each drawing-object is changed freely by changing the winning-probability data, a degree of variation for changing the winning-probability is high.

Patent Document 1: Japanese Published Unexamined Patent Application No. 2001-161889

DISCLOSURE OF THE INVENTION

Problems to be Solved by the Invention

However, in conventional drawing machines carrying out computer drawing, since generally, a participant of the drawing cannot understand a process of the drawing, it is difficult to give the participant of the drawing an impression like the drawing is carried out fairly. Especially, in case of executing a control to change a winning-probability of each of drawing-objects by changing winning-probability data, if the winning-probability of each of the drawing-objects is changed while the participants of the drawing do not know that, a result in which the participants of the drawing feel distrust is invited, it becomes more difficult to give the participant of the drawing an impression like the drawing is carried out fairly. In addition, in the case of executing a control to change the winning-probability of each of the drawing-objects by changing the winning-probability data, it may be considered to inform that the winning-probability of each of the drawing-objects have changed. However, since participants of the drawing cannot know how it has changed concretely, when it is only informed that the winning-probability of each of the drawing-objects have changed, the distrust felt by the participants of the drawing cannot be removed enough, whereby it is difficult to give the participants of the drawing an impression like the drawing is carried out fairly.

In view of backgrounds described above, the present invention realizes and provides a drawing machine and a game apparatus using the same by which it is easier to give the participants of the drawing an impression like drawing is carried out fairly when the computer drawing in which a winning-probability of each of drawing-objects is changed is carried out.

Means for Solving the Problem

As an aspect of the present invention, it is listed that a drawing machine for determining a winning-object from a plurality of drawing-objects includes: a winning-probability data storage unit for storing winning-probability data showing respective winning-probabilities of the plurality of drawing-objects; a drawing unit for carrying out drawings in accordance with the winning-probabilities of the drawing-objects determined by the winning-probability data stored in the winning-probability data storage unit and determining a winning-object from the plurality of drawing-objects; a winning-probability data changing unit for changing the winning-probability data stored in the winning-probability data storage unit; a winning-probability image displaying unit for displaying a winning-probability image showing the winning-probabilities of the drawing-objects determined by the winning-probability data stored in the winning-probability data storage unit; and a winning-probability displaying control unit for changing the winning-probability image displayed on the winning-probability image displaying unit, when the winning-probability data changing unit changes the winning-probability data, so as to correspond to the changed winning-probability data.

In the drawing machine, the winning-probability image showing the winning-probabilities of the respective drawing-objects by the drawing unit is displayed on the winning-probability image displaying unit. And, if the winning-probability data is changed in accordance with any condition whereby winning-probability of the drawing-object is changed, the winning-probability image displayed on the winning-probability image displaying unit is changed into that in accordance with winning-probability data after the change. Thereby, a participant of the drawing can check that the winning-probability image displayed on the winning-probability image displaying unit has been changed into that showing the winning-probabilities of the respective drawing-objects determined by the winning-probability data after the change, when the winning-probabilities of the respective drawing-objects was changed. Since the winning-probability image is that showing the winning-probabilities of the respective drawing-objects, the participant can understand how the winning-probabilities of the respective drawing-objects was changed concretely by checking such a change of the winning-probability image.

In addition, in the drawing machine, the winning-probability image may have image areas corresponding to the respective drawing-objects, and the winning-probability of each of the drawing-objects may be represented according to a size of the image area.

In the drawing machine, the participant of the drawing can understand visually how the winning-probability of each of the respective drawing-objects was changed concretely by looking at a state that a size of respective image areas composing the winning-probability image changes. Therefore, the participant can understand more easily how the winning-probability of each of the respective drawing-objects was changed concretely, whereby it become easier to give the participant an impression like the drawing is carried out fairly.

Also, in the drawing machine, in the respective drawings carried out by the drawing unit within a predetermined term, a winning-object may be determined from a rest of the drawing-objects which is obtained by excluding the winning-objects determined by the drawings already carried out within the predetermined term, from the plurality of drawing-objects, and the winning-probability data changing unit may determine the respective winning-probabilities of the rest of the drawing-objects in intervals between the respective drawings carried out by the drawing unit within the predetermined term, and changes the winning-probability data so that the winning-probabilities of the rest of the drawing-objects become the determined winning-probabilities, respectively.

In the drawing machine, consecutive drawings are carried out such that winning-objects determined by a drawing already carried out within a predetermined term are excluded from drawing-objects one by one, for example such as drawings of a general bingo game. In such drawings, whether the drawing is carried out, the numbers of drawing-objects are changed whereby the winning-probabilities of the respective drawing-objects are changed. In the present drawing machine, the participant of the drawing can understand visually a state that the winning-probabilities are changed when respective drawings of such consecutive drawings are carried out. Therefore, when consecutive drawings are carried out such that winning-objects determined by a drawing already carried out within a predetermined term are excluded from drawing-objects one by one, the participant can understand visually a state that the winning-probabilities are changed when respective drawings are carried out.

As another aspect of the present invention, it is listed that a game apparatus includes: the above-described drawing machine; and a game control unit for controlling progression of a game using a result of the drawing executed by the drawing machine.

In the game apparatus, it become easier that the participant of the drawing who has participated in computer drawing, in which the winning-probabilities of the respective drawing-objects is changed, is given a impression like the drawing is carried out fairly. Thereby, its game credibility is improved.

Also, the game apparatus may further include: a bet accepting unit for accepting a bet for a bet-object; and an allotment payout unit for paying out allotment, wherein the game control unit may decide whether a predetermined payout condition is met or not, based on the result of the drawings by the drawing machine, and when the game control unit decides that the predetermined payout condition is met, the game control unit may control the allotment payout unit to pay out a quantity of allotment corresponding to a quantity of the bet-object accepted by the bet accepting unit.

In the game apparatus, the participant of the drawing can play a so-called bet game that the participant bets a bet-object and will receive allotment when a predetermined payout condition decided based on a result of the drawing is met. The bet game is generally a game a main purpose of which is to receive allotment with respect to a participant of drawing. Therefore, it is especially important to give the participant of the drawing an impression like the drawing is carried out fairly. Consequently, where it is easier in such a bet game to give the participant an impression like the drawing is carried out fairly, a game attractiveness of the bet game, in which a game credibility is important, is much improved.

Further, in the game apparatus, the game control unit may control so that the quantity of allotment paid out by the allotment payout unit decreases when the winning-probability data is increased by the winning-probability data changing unit of the drawing machine, and the quantity of allotment paid out by the allotment payout unit may increase when the winning-probability data is decreased by the winning-probability data changing unit.

In the game apparatus, where the winning-probability data changing unit changed winning-probability data, there are cases where a payout ratio is changed in just like that. If a payout ratio is changed, management of the game balance becomes difficult, wherein it becomes impossible to provide high game attractiveness in a stable state. Also, where the game apparatus is a game apparatus for business use placed in an amusement hall such as a game center, and uses tangible entities such as tokens bought by a participant of drawing paying cash and electronic data equivalent thereto as bet-objects and allotment, it is important to fix almost the payout ratio in view of business management. For this reason, it is necessary to prevent the payout ratio from changing described above.

In the present game apparatus, since a quantity of allotment decreases when winning-probability data is increased and a quantity of allotment increases when winning-probability data is decreased, it is possible to fix almost the payout ratio before and after the winning-probability data changing unit changes the winning-probability data. Accordingly, it becomes easy to manage the game balance, and high game attractiveness can be stably brought about. In addition, where the game apparatus is used as the above-mentioned game apparatus for business use, the business management can be facilitated.

Furthermore, the game apparatus may include: an allotment quantity determination data storage unit for storing, for each of the plurality of drawing-objects, an allotment quantity determination data for determining the quantity of allotment paid out when the corresponding drawing-object is a winning-object determined next by the drawing unit so that the predetermined payout condition is met; and an allotment quantity image displaying unit for displaying allotment quantity images showing allotment quantities of the respective drawing-objects, the allotment quantities being determined based on the allotment quantity determination data stored in the allotment quantity determination data storage unit, wherein the game control unit, when the random selecting unit determines a winning-object so that when the random selecting unit determines a winning-object so that a predetermined payout condition is met, may control the allotment payout unit to pay out the quantity of allotment determined by the allotment quantity determination data corresponding to the winning-object, which is stored in the allotment quantity determination data storage unit, the game control unit may execute a control so that the payout ratio becomes almost fixed before and after the winning-probability data changing unit changes the winning-probability data by changing allotment quantity determination data stored in the allotment quantity determination data storage unit, and when the allotment quantity determination data is changed, the game control unit may execute a display control in order to change the allotment quantity image displayed on the allotment quantity image displaying unit to that in accordance with allotment quantity determination data after the change.

In the game apparatus, if the predetermined payout condition is met by the drawing unit having determined a winning-object, a quantity of the allotment determined by allotment quantity determination data corresponding to the winning-object is paid out. And, a control to fix almost a payout ratio before and after changing the winning-probability data is carried out by changing the allotment quantity determination data stored in the allotment quantity determination data storage unit.

Herein, in the present game apparatus, the participant of the drawing can understand that the participant obtains allotment of how much quantity when any drawing-object is drawn by the next drawing by looking at the allotment quantity image. And, where the allotment quantity determination data is changed for fixing the payout ratio, the participant can understand the quantity of allotment changed by the data changing by looking at the allotment quantity image. Therefore, it is prevented to occur a situation in which the allotment quantity determination data is changed whereby the quantity of allotment is changed while the participant does not know that. As a result, it is prevented to cause the participant to feel distrust. Also, the allotment quantity image may be an image to show a quantity of allotment directly or to show a rate of allotment even if a player can understand a quantity of allotment by looking at the allotment quantity image.

Also, in the game apparatus, the allotment quantity image may have image areas corresponding to the respective drawing-objects, and a difference of colors of the respective image areas may correspond to a difference of the allotment quantities of the respective drawing-objects.

In the game apparatus, the participant of the drawing can know a difference of allotment quantities of the respective drawing-objects by a difference of colors of the respective image areas composing the allotment quantity image. Therefore, since the participant can understand easily selection how the allotment quantities of the respective drawing-objects change, its game credibility is improved.

Also, the game apparatus may further include: an array image displaying unit for displaying an array image in which a plurality of drawing-object-images corresponding to part or all of the plurality of drawing-objects are arrayed; and a winning-object storage unit for storing the winning-objects already determined by the drawing unit of the drawing machine within a term in which a plurality of times of the drawings are carried out by using the drawing machine, wherein the game control unit may control the allotment payout unit to pay out the allotment if a predetermined payout condition is met, the condition being defined so that the plurality of winning-objects stored in the winning-object storage unit form a predetermined combination, and the predetermined combination may be a combination of winning-objects in which an array of the drawing-object-images in the array image corresponding to a plurality of winning-objects stored in the winning-object storage unit becomes a predetermined array.

In the game apparatus, a game, for example a so-called bingo game, such that allotment is paid out when an array of the drawing-object images corresponding to a plurality of the winning-objects becomes a predetermined array. Therefore, a game credibility of the bingo game, etc., which is a kind of the bet game, is improved.

Effect of the Invention

According to the present invention, when the computer drawing in which the winning-probabilities of the respective drawing-objects is changed is carried out, a participant of the drawing can understand visually how the winning-probabilities of the respective drawing-objects was changed concretely when the winning-probabilities of the respective drawing-objects was changed. Thereby, it is easier to give the participant of the drawing an impression like drawing is carried out fairly.

BRIEF DESCRIPTION OF DRAWINGS

FIG. 1A is a descriptive view showing an example of a main screen displayed on a large-sized display when a number "12" has become a winning-number by a first drawing in a bingo game of a bingo game machine according to an embodiment.

FIG. 1B is a descriptive view showing an example of the main screen before an eleventh drawing is carried out.

FIG. 2 is a perspective view of the entire appearance of the bingo game machine.

FIG. 3 is a front view showing a station of the bingo game machine.

FIG. 4 is a top view of the station 10.

FIG. 5 is a block diagram showing a major hardware configuration of the bingo game machine.

FIG. 6 is a functional block diagram showing major parts of the bingo game machine.

FIG. 7 is a descriptive view showing a game screen displayed on a touch panel of the station.

FIG. 8 is a flowchart showing a flow of a bingo game according to the bingo game machine.

FIG. 9 is a flowchart showing a flow of a winning-probability changing process.

FIG. 10 is a descriptive view showing an example of the main screen after a winning-probability has changed by the winning-probability changing process.

FIG. 11 is a flowchart showing a flow of an attack process.

FIG. 12 is a flowchart showing a flow of an attack process according to another example.

FIG. 13 is a flowchart showing a flow of a winning-probability changing process according to another example.

FIG. 14 is a flowchart showing a flow of a winning-probability changing process according to yet another example.

DESCRIPTION OF REFERENCE NUMERALS

2 Large-sized display
7 RAM
8 ROM
9 Sub storage device
10 Station
11 Touch panel
12 Attack button
18 Token management device
20 Computer drawing machine
101 Game progression control unit
102 Card generating unit
103 Station displaying unit
104 Main displaying unit
105 Drawing unit
106 Winning-probability changing unit
107 Bingo decision unit
108 Odds management unit

BEST MODE FOR CARRYING OUT THE INVENTION

Hereinafter, a description is given of one embodiment in which the present invention is applied to a bingo game machine being a game apparatus for business use placed in an amusement hall such as a game center.

FIG. 2 is a perspective view showing the entire appearance of a bingo game machine according to the embodiment.

The bingo game machine is composed of one game machine body 1 and seven stations 10. In the bingo game machine according to the embodiment, seven players or less who are participants of drawing can simultaneously join and play a bingo game in which twenty-five drawing-objects (numbers from "1" to "25") are selected one by one by a computer drawing described later. The number of drawing-objects and the maximum number of game participants are optional. Respective players join and play a bingo game using any one of the stations 10. The game machine body 1 is provided with a large-sized display 2 at a position where the respective players are able to visually recognize. Also, the game machine body 1 is also provided with a speaker 3, which is a sound outputting unit operating as sound outputting means, and an illumination device in order to carry out various types of performances and notification to the players.

FIG. 3 is a front view of the station 10. FIG. 4 is a top view of the station 10. Since the seven stations are composed of the same configuration, a description is given below of one of the seven stations.

The station 10 includes a touch panel 11 that is an operation unit operating as operating means; an attack button 12; a token inputting port 13 for inputting tokens; a token receiving portion 14 for receiving tokens by refunding credits; and a refund button 15 for instructing refund of credits. The touch panel 11 displays a game screen including a bingo card image (array image) in which number images (drawing-object-images) of "1" through "25" are arrayed in form of a matrix, etc. A player can carry out various types of operations by touching respective types of images in the game screen.

FIG. 5 is a block diagram showing a main hardware configuration of the bingo game machine.

The bingo game machine according to the embodiment has a controller 4 in the interior of the game machine body 1, which controls movements of the entire game machine. The touch panel 11 of the respective stations 10 is controlled by the controller 4. The controller 4 is composed of a microprocessor, etc., and carries out various types of calculations necessary for game progression and operational control of various types of devices. The controller 4 is connected via a bus to a screen drawing controller 16, which draws various types of images on the touch panel 11 in accordance with instructions from the controller 4. Also, the controller 4 is connected to an input controller 17, which controls data inputted by touching various types of images drawn on the touch panel 11 via the bus. Further, the controller 4 is also connected to a token management device 18 via the bus. These devices 16, 17 and 18 are provided in the interior of the respective stations 10. In addition, although not illustrated, an operation brought about when pressing the attack button 12 is transmitted to the controller 4 via the bus.

The token management device 18 stores credit data showing the number of tokens that a player owns. When tokens are inputted into the token inputting port 13, the token management device 18 executes a process of adding the credit equivalent to the number of inputted tokens to the credit data. In addition, the token management device 18, which is an allotment payout unit, functions as allotment paying-out means when receiving a payout instruction from the controller 4 and executes a process of adding credits of the quantity in accordance with the payout instruction to the credit data as allotment. Also, when the token management device 18 receives a bet instruction from the controller 4, the device 18 executes a process of subtracting credits of the quantity in accordance with the bet instruction from the credit data.

Additionally, the controller 4 is connected via the bus to a sound controller 5 for outputting, from a speaker, sounds for performances in accordance with an instruction from the controller 4, and a large-sized screen controller 6 for drawing various types of images in accordance with instructions of the controller 4 on the large-sized display 2.

Further, the controller 4 is connected via the bus to a computer drawing machine 20 for carrying out number drawing in accordance with an instruction from the controller 4, a RAM 7, a ROM 8 and an auxiliary storage device 9, which function as various types of storage means. In the ROM 8, programs and data necessary to control basic operations when commencing the bingo game machine, and main programs necessary to control game progression are stored. The auxiliary storage device 9 is a rewritable storage device that is composed of a hard-disk storage device, etc., and stores data and programs that cannot be stored in the RAM 7 and the ROM 8. The data and programs stored in the auxiliary storage device 9 are loaded into a predetermined area of the RAM 7 in response to an instruction from the controller 4, and are utilized.

FIG. 6 is a functional block diagram showing major parts in the bingo game machine.

In the embodiment, the bingo game machine is composed mainly of a game progression control unit 101, a card generating unit 102, a station displaying unit 103, a main displaying unit 104, a drawing unit 105, a winning-probability changing unit 106, a bingo decision unit 107 and an odds management unit 108.

The game progression control unit 101 is composed of the controller 4, the RAM 7, the ROM 8, and the auxiliary storage device 9, etc., in the hardware configuration shown in FIG. 5. The game progression control unit 101, which is a game control unit, functions as game controlling means by the controller 4 executing a game progression program stored in the ROM 8 or the auxiliary storage device 9. Also the game progression control unit 101 carries out various types of control and processes described later.

The card generating unit 102 is composed of the controller 4, the RAM 7, the ROM 8, and the auxiliary storage device 9, etc., in the hardware configuration shown in FIG. 5. The card generating unit 102 reads an array determination program to array the numbers "1" through "25" in form of a matrix at random from the auxiliary storage device 9 when receiving a card generation instruction from the game progression control unit 101, and generates array information. Although the matrix according to the embodiment is a 5×5 square matrix, it is not limited thereto. The generated array information is stored in the array-information-storage-area of the RAM 7. The array information stored in the RAM 7 is utilized by the game progression control unit 101, etc.

Also, in the embodiment, the quantity of the numbers read from the auxiliary storage device 9 is coincident with the quantity of number images that compose the matrix, but the quantity of the numbers may be smaller than or greater than the quantity of number images.

The station displaying unit 103 is composed of the touch panel 11 and the image drawing controller 16, etc., in the hardware configuration shown in FIG. 5. The station displaying unit 103 displays images on the touch panel 11 in accordance with various types of displaying instructions from the game progression control unit 101. In detail, when a card displaying instruction based on the array information stored in the array-information-storage-area of the RAM 7 is transmitted from the game progression control unit 101, the station displaying unit 103, which is the array image displaying unit, functions as array image displaying means and displays a bingo card image consisting of the number images of "1" through "25" arrayed in form of a 5×5 matrix on the touch panel 11 in accordance with the card displaying instruction.

The main displaying unit 104 is composed of the large-sized display 2 and the large-sized screen controller 6, etc., in the hardware configuration shown in FIG. 5. The main displaying unit 104 displays images on the large-sized display 2 in accordance with various types of displaying instructions from the game progression control unit 101. In detail, when a displaying instruction of a roulette image as a winning-probability image showing winning-probability of each of numbers, which is determined by the winning-probability data stored in the winning-probability-storage-area of the RAM 7, is transmitted from the game progression control unit 101, which is a winning-probability displaying control unit, operating as winning-probability displaying control means, the main displaying unit 104, which is the winning-probability image displaying unit, functions as winning-probability image displaying means and displays the roulette image on the large-sized display 2 in accordance with the displaying instruction. Also, the large-sized display 2 may be any type of display as long as it can display pictures based on electronic signals from the large-sized screen controller 6.

The drawing unit 105 is composed of the computer drawing machine 20, RAM 7, ROM 8 and auxiliary storage device 9, etc., in the hardware configuration shown in FIG. 5. When the drawing unit 105 receives a drawing commencement instruction from the game progression control unit 101, the drawing unit 105 functions as drawing means and carries out the computer drawing in accordance with the winning-probability of each of the drawing-objects, which is determined by the winning-probability data stored in the winning-probability-storage-area of the RAM 7 being a winning-probability data storage unit operating as winning-probability data storage means. As a result, winning numbers are determined. The determined winning numbers are stored in the winning-history-storage-area of the RAM 7 that is the winning-object storage unit operating as winning-object storage means.

The winning-probability changing unit 106 is composed of the controller 4, RAM 7, ROM 8, and auxiliary storage device 9, etc., in the hardware configuration shown in FIG. 5. The winning-probability changing unit 106 changes the winning-probability data stored in the winning-probability-storage-area of the RAM 7 in accordance with a winning-probability changing instruction from the game progression control unit 101. A changing process of the winning-probability data will be described later.

The bingo decision unit 107 is composed of the computer drawing machine 20, RAM 7, ROM 8 and auxiliary storage device 9, etc., in the hardware configuration shown in FIG. 5. When the bingo decision unit 107 receives a decision instruction from the game progression control unit 101, the bingo decision unit 107 carries out a bingo decision process based on the winning numbers stored in the winning-history-storage-area of the RAM 7 and the array information stored in the array-information-storage-area of the RAM 7. In the bingo decision process, for each array information stored in the array-information-storage-area of the RAM 7, it is decided whether or not arrays, that are on the matrix based on the corresponding array information, of the numbers corresponding to a plurality of winning numbers stored in the winning-history-storage-area of the RAM 7 coincide with a predetermined bingo array. The predetermined bingo array according to the embodiment is an array in which all the number images arrayed in any line in the longitudinal direction, the horizontal direction and the diagonal direction on the bingo card image become winning numbers. And, where the array of a plurality of winning numbers stored in the winning-history-storage-area of the RAM 7 is the predetermined bingo array, it is determined that BINGO is established with respect to the corresponding array information. Where it is determined that BINGO has been established, the bingo decision unit 107 transmits bingo generation information of BINGO having occurred, to the game progression control unit 101.

In addition, in the embodiment, the bingo decision unit 107 carries out a process for deciding whether or not only one number is needed to reach one or more of the predetermined bingo arrays when it receives the decision instruction from the game progression control unit 101. In the process, it is decided that a state of waiting for the last number of the predetermined bingo array(s) occurs when entering the state in which BINGO occurs if a specified number is drawn next, based on the winning numbers stored in the winning-history-storage-area of the RAM 7 and the array information stored in the array-information-storage-area of the RAM 7. Where it is decided that the state of waiting for the last number of the predetermined bingo array(s) occurs, the bingo decision unit 107 transmits occurrence information of the state, to the game progression control unit 101.

The odds management unit 108 is composed of the computer drawing machine 20, RAM 7, ROM 8 and auxiliary storage device 9, etc., in the hardware configuration shown in FIG. 5. When the odds management unit 108 receives an odds calculation instruction from the game progression control unit 101, the odds management unit 108 calculates the odds data for each of the respective numbers, which is the allotment quantity determination data, to determine the quantity of allotment to be paid out by meeting the payout condition including bingo establishment if the corresponding number were the winning number determined next by the drawing unit 105. The calculation process of the odds data is carried out whenever drawings coming after the fourth time drawing are carried out by the drawing unit 105. Usually, in the calculation process of the odds data, the odds are calculated so that the quantity of allotment decreases as the number of times of drawing increases. Although the details will be described later, the odds are calculated for the numbers whose winning-probabilities increase by the winning-probability changing unit 106, so that the quantity of allotment decreases. The odds data calculated is stored in an odds-storage-area of the RAM 7, which is an allotment quantity determination data storage unit, operating as allotment quantity determination data storage means.

FIG. 7 is a descriptive view showing one example of a game image displayed on the touch panel 11. Two bingo card images are displayed on the game screen. The numbers enclosed by a square frame on the respective bingo card image show those won in the drawings carried out up until the present time, and the numbers enclosed by a circular frame shows those that are not yet won. The display pattern of number "16" positioned at the right lower corner of the left side bingo card image in the figure is a display pattern when a player desires to win and touches the number. This number is a winning-desired number. Also, the winning-desired number on the right side bingo card image in the figure is displayed by being enclosed by a large circular frame.

In addition, a BET-display-column 11*a* showing the credit quantity (token quantity) as bet-objects bet by a player, a credit-acquisition-quantity-display-column 11*b* showing the credit quantity acquired by generation of BINGO, a credit-display-column 11*c* showing the present credit quantity of the player, etc., are displayed at the lowermost part of the game screen. Also, on these display columns, a winning-history-display-column 11*d* showing the numbers, which are won by the drawings up until the present time, from the left side in the figure in order is provided. Further, the example of illustrated in the figure shows a state where a drawing has been carried out ten times up until the present time.

Also, an allotment-quantity-display-column 11*e* is displayed on the uppermost part of the game screen. The allotment-quantity-display-column 11*e* shows the relationship between the colors and the allotment quantity, which are described later. The allotment quantities of the respective colors are obtained by multiplying the odds data corresponding to the respective colors by the bet quantity of the player.

Furthermore, attack-gauge-display-column 11*f* is displayed on the left upper part of the game screen. An attack gauge of the attack-gauge-display-column 11*f* is increased by meeting predetermined conditions, and if the attack gauge becomes full, an attack-operation described later can be carried out. The details will be described later.

Next, a description is given of operations of the present bingo game machine in accordance with flows of a bingo game according to the embodiment.

FIG. 8 is a flowchart showing the flows of the bingo game.

In the bingo game machine, if a player inputs tokens into the token inputting port 13 of the station 10, the number of tokens inputted is detected by the token management device 18, and credit equivalent to the number of inputted tokens is stored in the credit data. Also, when the token management device 18 detects input of tokens, it notifies the controller 4, which composes the game progression control unit 101, of the detection.

In detail, the game progression control unit 101 that received information that tokens are inputted outputs a bet screen displaying instruction to the station displaying unit 103. Whereby a bet screen is displayed on the touch panel 11 of the station 10 in which the player input the tokens. Two bet buttons, one of which is a one-bet button and the other of which is a ten-bet button, are displayed on the bet screen. The player can bet credit of the desired quantity by touching these bet buttons. If the player touches these bet buttons, the bet data showing the bet quantity is transmitted from the input controller 17 to the game progression control unit 101. The game progression control unit 101 as the bet accepting unit functions as bet accepting means and accepts the bet, and outputs a bet instruction to the token management device 18. Thereby, the token management device 18 carries out a process of subtracting credits equivalent to the number of tokens corresponding to the bet instruction and adding the credits equivalent to the number to the bet data (S1). Thus, the player can bet the credits only by touching the bet buttons equivalent to a desired number of bets.

Also, the game progression control unit 101 outputs a displaying instruction to the station displaying unit 103 when receiving bet data from the input controller 17, and revises the BET-display-column 11*a* and the credit-display-column 11*c* on the game screen of the touch panel 11.

Further, when the game progression control unit 101 receives bet data from the input controller 17, it calculates the allotment quantity in response to the bet data stored in the token management device 18 based on eight odds data stored in the odds-storage-area of the RAM 7. In the embodiment, the eight odds data, which are 1.5 times, 2.5 times, 3.5 times, 5 times, 8 times, 12 times, 20 times and 30 times, are stored in the odds-storage-area of the RAM 7 made to correspond to the respective number as the basic odds data. The game progression control unit 101 calculates the allotment quantity corresponding to respective odds data by multiplying the bet data stored in the token management device 18 by respective odds data. And, the game progression control unit 101 outputs a displaying instruction to the station displaying unit 103 and makes the station displaying unit 103 revise the allotment quantities displayed in eight odds-sections in the allotment-quantity-display-column 11*e* on the game screen of the touch panel 11 to the calculated allotment quantities. The eight odds-sections are displayed by different colors, respectively, and the respective colors correspond to the roulette colors described later.

After the bet acceptance is finished, the game progression control unit 101 outputs the card generation instruction to the card generating unit 102. Thereby, the card generating unit 102 executes the array determination program and generates two pieces of array information of bingo cards, and the generated two pieces of array information is stored in the array-information-storage-area of the RAM 7. After the card generating unit 102 has generated array information, the game progression control unit 101 reads the two pieces of array information from the array-information-storage-area of the RAM 7, and outputs the card displaying instruction based on the array information to the station displaying unit 103. Thereby, two bingo card images consisting of "1" through "25" number images arrayed at random in form of a 5×5 matrix are displayed on the touch panel 11 of the stations 10 in which the player inputs tokens (S2). In the embodiment, although a description is given of a case where two bingo card images are displayed on the touch panel 11 of one station 10, one bingo card image may be displayed or three or more bingo card images may be displayed.

After the bingo card images are thus displayed on the touch panel 11 of the station 10, the first through the fourth drawings are carried out (S3). In detail, the game progression control unit 101 outputs a commencement instruction of the first drawing to the drawing unit 105. And, the drawing unit 105 carries out the computer drawing in accordance with the winning-probability of each of the numbers, which are determined by the winning-probability data stored in the winning-probability-storage-area of the RAM 7, thereby a winning number are determined. A detailed description is given of one example of a drawing process carried out by the drawing unit 105. A predetermined range of random numbers is divided into sections corresponding to respective unwinning numbers, respectively, so that winning-probability of each of the unwinning numbers that are not won up until the present time are made into winning-probabilities determined the corresponding winning-probability data stored in the winning-probability-storage-area of the RAM 7. Therefore, in the first drawing, sections corresponding to the numbers "1" through "25" are allotted among the predetermined random number range. In the second drawing, sections corresponding to twenty-four unwinning numbers, excluding the number won in the first drawing, of "1" through "25" are allotted among the predetermined random number range. In the third drawing, sections corresponding to the unwinning numbers excluding the numbers won up until that time are allotted as in the preceding drawings. If the winning-probability is changed by the winning-probability changing process described later, the respective sections are evenly allotted. After the predetermined random number range is thus divided, random numbers are generated. And, a section to which the random number belongs is specified, and the number corresponding to the specified section is determined as a winning number. The determined winning number is stored in the winning-history-storage-area of the RAM 7 as a winning number.

Also, the game progression control unit 101 outputs a roulette turning instruction to the main displaying unit 104. Thereby, the main displaying unit 104 turns the roulette of a roulette image displayed on the large-sized display 2 and executes performance of the drawing.

FIG. 1A is a descriptive view showing one example of the main screen displayed on the large-sized display 2 when a number "12" has become a winning-number by the first drawing. FIG. 1B is a descriptive view showing one example of the main screen before an eleventh drawing is carried out. The roulette image having image areas corresponding to the numbers, which have not yet won, of "1" through "25" is displayed on the main screen. Therefore, a roulette image having the image areas corresponding to all of "1" trough "25" is displayed in a performance of the first drawing as shown in FIG. 1A. A roulette image having the image areas corresponding to twenty-four numbers, excluding the number won in the first drawing, of "1" through "25" is displayed in a performance of the second drawing. And, in a performance of a subsequent drawing, a roulette image having the image areas corresponding to the numbers excluding the numbers won up until that time is displayed. FIG. 1B shows the main screen displaying a roulette image for a performance of the eleventh drawing after numbers of "12", "19", "2", "24", "21", "5", "22", "17", "8" and "11" have become winning numbers in the first through the tenth drawings as shown in FIG. 7.

Herein, differences in size of the image areas of the respective numbers in the roulette image on the large-sized display 2 express the winning-probability of each of the numbers. Unless the winning-probabilities are changed by the winning-probability changing process described later, the sizes of the image areas of the respective numbers on the roulette image become equal to each other because the winning-probability of each of the numbers are equal. However, according to the embodiment, in respective drawings executed by the drawing unit 105 that carries out drawings twelve times (a predetermined term) in one bingo game, as described above, winning numbers are determined from numbers excepting the winning numbers which have been determined by drawings executed in the past. Therefore, the winning-probability of each of the unwinning numbers rises whenever the number of times of drawings is increased even if the winning-probability of each of the unwinning numbers is equal in individual drawing.

In detail, before the first drawing is commenced, the winning-probability data all the winning-probability of each of which is equal regarding the twenty-five numbers are stored beforehand in the winning-probability-storage-area of the RAM 7. After the first drawing by using the winning-probability data is finished, the game progression control unit 101 outputs a winning-probability changing instruction to the winning-probability changing unit 106 before outputting a second drawing commencement instruction to the drawing unit 105. Thereby, the winning-probability changing unit 106, which is a winning-probability data changing unit, functions as winning-probability data changing means and changes the winning-probability data stored in the winning-probability-storage-area of the RAM 7 in accordance with the winning-probability changing instruction so that all the respective winning-probabilities of the twenty-four unwinning number are equal. By the change, with respect to the second drawing process by the drawing unit 105, the respective sections corresponding to the unwinning numbers in the predetermined range of random numbers is widened equally. As a result, the winning-probability of each of the unwinning numbers in the second drawing is higher than that in the first drawing. After that, the game progression control unit 101 outputs the second drawing commencement instruction to the drawing unit 105. Also, the game progression control unit 101, which is a winning-probability displaying control unit, functions as winning-probability displaying control means and outputs a roulette change displaying instruction to the main displaying unit 104. The main displaying unit 104 received the roulette change displaying instruction displays the roulette image having the image areas, the size of which is corresponding to the respective winning-probabilities, corresponding to the twenty-four respective unwinning numbers on the large-sized display 2. Herein, since the respective winning-probabilities are equal, the roulette image has the twenty-four image areas the size of which is equal. After that, the game progression control unit 101 outputs the second drawing commencement instruction to the drawing unit 105 and makes the drawing unit 105 carry out the second drawing.

The colors of the image areas of the respective numbers in the roulette image on the large-sized display 2 correspond to the allotment quantities of the respective numbers. That is, the colors of the image areas of the respective numbers correspond to those of eight odds-sections of the allotment-quantity-display-column 11*e* displayed on the game screen of the touch panel 11 of the station 10. Therefore, a player can easily understand the quantity of allotment paid out where a number is drawn in the next drawing and bingo is thereby completed, by look at the colors of the respective numbers on the roulette image on the large-sized display 2.

After the game progression control unit 101 outputs the second drawing commencement instruction to the drawing unit 105, it outputs the roulette turning instruction to the main displaying unit 104. When the main displaying unit 104 receives the roulette turning instruction, it carries out performance of executing a drawing by turning the roulette of the roulette image displayed on the large-sized display 2. After that, the game progression control unit 101 reads the winning number stored in the winning-history-storage-area of the RAM 7 and outputs, to the main displaying unit 104, a performance displaying instruction showing that the winning number is drawn. Therefore, as shown in FIG. 1A, the main displaying unit 104 executes performance of causing the number image corresponding to the winning number to appear at the center part of the roulette image displayed on the large-sized display 2. Also, the example shown in FIG. 1B is a case where "12" is the winning number. That is, the main displaying unit 104, which is a notifying unit, functions as notifying means for providing a notification of the winning number to a player whenever the drawing unit 105 determines the winning number.

In addition, when the game progression control unit 101 reads the winning number stored in the winning-history-storage-area of the RAM 7, it outputs a displaying instruction to the station displaying unit 103. And the game progression control unit 101 make the station displaying unit 103 revise the winning history display part 11*d* on the game screen of the touch panel 11, and change the number image corresponding to the winning number on the bingo card image from those of being enclosed in a circular frame to those of being enclosed in a square frame. That is, the station displaying unit 103, which is the notifying unit, functions as the notifying means for providing a notification of the winning number to a player whenever the drawing unit 105 determines the winning number.

After such a process of drawing is repeated by fourth drawing and the fourth drawing is carried out, the game progression control unit 101 outputs a decision instruction to the bingo decision unit 107. Thereby, the bingo decision unit 107 carries out the above-described process for deciding whether or not only one number is needed to reach one or more of the predetermined bingo arrays (S4). Where it is decided in the process that the state of waiting for the last number of the predetermined bingo array(s) occurs, the bingo decision unit 107 transmits the occurrence information of the state to the game progression control unit 101, and the game progression control unit 101 sets a flag showing the state with respect to the corresponding array information (S5).

Next, the game progression control unit 101 executes a winning-probability changing process of a winning desired number that a player desires to win (S20). The winning-probability changing process is carried out whenever the fourth drawing, the sixth drawing, the eighth drawing and the tenth drawing are finished. A detailed description of the winning-probability changing process will be given later.

Subsequently, the game progression control unit 101 executes the fifth drawing, and determines the fifth winning number (S6). And, the game progression control unit 101 outputs a decision instruction to the bingo decision unit 107, and makes the bingo decision unit 107 execute the above-described bingo decision process (S7). The bingo decision process decides whether or not BINGO has occurred, based on the winning numbers (five winning numbers at the present) stored in the winning-history-storage-area of the RAM 7 and the array information stored in the array-information-storage-area of the RAM 7. Where it is decided that BINGO has occurred, the bingo decision unit 107 transmits bingo occurrence information to the game progression control unit 101. The game progression control unit 101 that receives the information outputs to the token management device 18 a payout instruction which instructs payout of the allotment quantity of an odds-section corresponding to the winning numbers won by the drawings of the five times. The token management device 18 that receives the payout instruction temporarily stores the allotment quantity corresponding to the payout instruction and carries out a process of adding the credits equivalent to the allotment quantity to the credit data when the bingo game is finished (S8).

Also, the bingo decision unit 107 that receives a decision instruction executes the above-described process for deciding whether or not only one number is needed to reach one or more of the predetermined bingo arrays (S9), and where it is determined that the state of waiting for the last number of the predetermined bingo array(s) occurs, the flag showing the state is set for the corresponding array information (S10).

After that, the game progression control unit 101 outputs an odds calculation instruction to the odds management unit 108. Thereby, the odds management unit 108 revises the odds data of the respective numbers (S11). In detail, the odds management unit 108 calculates the odds data for each of the unwinning numbers that are not drawn up until the present time. The calculated odds data is stored in the odds-storage-area of RAM 7 in connection with the corresponding unwinning numbers. In the embodiment, when the fourth drawing is finished, the basic odds data of 30 times is selected for all of the twenty-one unwinning numbers. That is, when BINGO is established at the fifth drawing, the odds are 30 times. And, unless the odds data is changed in the winning-probability changing process described later, the basic odds data that is lower by one rank than the current basic odds data is selected with respect to the respective unwinning numbers whenever the drawings coming after the fifth time are finished, and the odds data is stored in the odds-storage-area of the RAM 7. Therefore, unless the odds data is changed in the winning-probability changing process described later, the basic odds data of 20 times, which is lower by one rank than 30 times being the current basic odds data, is selected evenly for twenty unwinning numbers when the fifth drawing is finished. Whenever subsequent drawings are finished, the basic odds data that is lower by one rank is selected evenly for the remaining numbers in order. Since the probability of establishing BINGO rises whenever the number of times of drawings is increased, it is possible to fix almost the payout ratio by the odds data being changed whenever the sixth and subsequent drawing are finished.

Herein, the allotment quantity displayed in the allotment-quantity-display-column 11*e* on the game screen of the touch panel 11 of the station 10 is revised when performances of the fourth, the sixth, the eight, and the tenth drawing are finished. And, the allotment quantity corresponding to the basic odds data is displayed in the sections of the respective colors of the allotment-quantity-display-column 11*e* until three numbers on the same line on the bingo card image displayed in the game screen become winning numbers. On the other hand, where three or four numbers on the same line on the bingo card image have become winning numbers when the allotment-quantity-display-column 11*e* is revised, the allotment quantities corresponding to the actual odds data are displayed in the sections corresponding to the respective colors of the allotment-quantity-display-column 11*e*. The actual odds data is calculated by the odds management unit 108 based on the probabilities by which BINGO is established in the subsequent two drawings (that is, drawings executed until the allotment-quantity-display-column 11*e* is next revised). In detail, the actual odds data is calculated based on the winning-probability of each of the numbers in the revision (the winning-probabilities after change if the winning-probability data is changed by the winning-probability changing process described later) and the arrangement of numbers on a matrix array obtained from the array information corresponding to a bingo card image displayed on the touch panel 11 corresponding to the station 10 in the revision. By carrying out such a process, where the touch panel 11 of the station 10 displays a bingo card image having three or four numbers on the same line thereof become winning numbers when revising the allotment-quantity-display-column 11*e*, the allotment quantity displayed on the allotment-quantity-display-column 11*e* is changed from the allotment quantity based on the basic odds data to the allotment quantity based on the actual odds data. As a result, after three or four numbers on the same line become winning numbers, individual allotment quantities are displayed in the allotment-quantity-display-column 11*e* on the touch panel 11 of the respective stations 10. That is, although the numbers and colors of the respective odds-sections divided by colors on the allotment-quantity-display-columns 11*e* are common to all the stations 10, the allotment quantities displayed in the odds-sections are different at the respective stations 10.

After the odds data of respective unwinning numbers are stored in the odds-storage-area of the RAM 7 by the odds management unit 108, the game progression control unit 101, which is a winning-probability displaying control unit, operating as winning-probability displaying control means and outputs a roulette change displaying instruction to the main displaying unit 104. The main displaying unit 104 received the roulette change displaying instruction, which is a winning-probability image displaying unit and a allotment quantity image displaying unit, functions as winning-probability image displaying means and allotment quantity image displaying means. And, the main displaying unit 104 makes the large-sized display 2 display a roulette image, having image areas of the unwinning numbers at this point in time (twenty numbers at the point when the fifth drawing is finished), in which the colors of the respective image areas are colors corresponding to the odds data revised in the above step S11 (S12).

And, the game progression control unit 101 decides which time the number of times of drawings finished up until the present time is, the sixth time, the eighth time, or the tenth time (S13). Where it is decided that the drawing is either one of the sixth, the eighth or the tenth drawing, the winning-probability changing process for changing winning-probability of the winning desired number that the player desires to win is carried out (S20). That is, in the embodiment, the winning-probability changing process is carried out whenever the fourth, the sixth, the eighth and the tenth drawings are finished. On the other hand, where it is decided that the drawing is neither of the sixth, the eighth nor the tenth drawing, the game progression control unit 101 decides whether or not the number of times of drawings finished up until the present time reaches 12 times (S14). And, where it is decided that the number of times of drawings does not reach 12 times, the next drawing process is executed without carrying out the winning-probability changing process (S6). On the other hand, where it is decided that the number of times of drawings reaches 12 times, the bingo game is finished.

After the bingo game is finished, the token management device 18 carries out a process of adding the credits equivalent to the allotment quantity temporarily stored upon receiving a payout instruction during the bingo game to the credit data. Thereby, the credit quantity displayed in the credit-display-column 11*c* becomes the credit quantity after being added.

Next, a description is given of the winning-probability changing process for changing winning-probability of the winning desired number that the player desires to win.

FIG. 9 is a flowchart showing a flow of the winning-probability changing process.

In the embodiment, after the fourth, the sixth, the eighth and the tenth drawings are finished, the game progression control unit 101 outputs to the station displaying unit 103 a displaying instruction of causing the station displaying unit 103 to display a description image for urging a player to touch a number that the player desires to win. Thereby, the station displaying unit 103 displays a description image saying, "Please touch your desired number" on the game screen of the touch panel 11 as shown in FIG. 7. Within the time limit, the player who looked at the description image selects one of the number images of unwinning numbers in the bingo image displayed on the game screen of the touch panel 11, and touches the number. If so, the winning-desired number information showing the touched number is outputted from the input controller 17, and the winning-desired number information is accepted by the game progression control unit 101 (S21). Also, if no winning-desired number information is accepted within the time limit, the winning-probability changing process is finished as it is.

If the game progression control unit 101, which is a winning desired number determination unit, accepts the winning-desired number information, it functions as winning desired number determination means and determines the winning-desired number that the player desires to win, which is a desired drawing-object. And, the game progression control unit 101 outputs a winning-probability changing instruction to the winning-probability changing unit 106. Thereby, the winning-probability changing unit 106, which is the winning-probability data changing unit, functions as winning-probability data changing means and changes the winning-probability data stored in the winning-probability-storage-area of the RAM 7 so that the winning-probability of the winning-desired number corresponding to the winning-probability changing instruction is increased (S22). By the change, with respect to a drawing process by the drawing unit 105, the section corresponding to the winning-desired number in the predetermined range of random numbers is widened, and the sections of the remaining unwinning numbers are evenly narrowed. As a result, the winning-probability of the winning-desired number is increased.

Herein, in the embodiment, seven players can simultaneously join a bingo game at maximum. Therefore, there may be cases where a plurality of pieces of winning-desired number information differing from each other is accepted from the input controllers 17 of a plurality of stations 10, respectively. In this case, the game progression control unit 101 outputs a winning-probability changing instruction for each pieces of the winning-desired number information, whereby the winning-probability changing unit 106 changes the winning-probability data stored in the winning-probability-storage-area of the RAM 7 so that the winning-probability of the winning-desired number corresponding to the winning-probability changing instruction is increased. As a result, in the drawing process by the drawing unit 105, the sections corresponding to the winning-desired numbers in a predetermined range of random numbers are widened, and the sections of the remaining unwinning numbers are evenly narrowed. Whereby the winning-desired number corresponding to the winning-desired number information that is more accepted will have higher winning-probability. However, in a case where the winning-desired number information is accepted from a plurality of players, if the winning-desired number information from many players is concentrated on a specified number, there may be cases where, even if the winning-desired number information corresponding to other numbers is accepted, the winning-probability of each of the other numbers are lowered.

In addition, the game progression control unit 101 outputs an odds calculation instruction to the odds management unit 108. Thereby, the odds management unit 108 reads the winning-probability data changed in the above step S22 from the winning-probability-storage-area of the RAM 7, and carries out a process of changing the odds data in the odds-storage-area of the RAM 7 based on the winning-probability data (S23). In detail, the odds management unit 108 changes the odds data allotted to the respective unwinning numbers before and after changing the winning-probability data in the above step S22, so that the payout ratio becomes almost fixed. Therefore, the odds data of the respective unwinning numbers is changed so that the odds data of the unwinning numbers whose winning-probabilities are increased by the change of the winning-probability data in the above step S22 is relatively low.

Subsequently, the game progression control unit 101, which is a winning-probability displaying control unit, functions as winning-probability displaying control means and outputs a roulette change displaying instruction to the main displaying unit 104 based on the winning-probability data after a change, so that the size of the image area of each of the unwinning numbers in the roulette image becomes a size corresponding to the winning-probability after the change, and the color of the image area of each of the unwinning numbers becomes a color corresponding to the odds data after the change. Thereby, the main displaying unit 104, which is a winning-probability image displaying unit and an allotment quantity image displaying unit, functions as winning-probability image displaying means and allotment quantity image displaying means, so that the main displaying unit 104 displays a roulette image, in which the size of the image area of each the unwinning number is a size corresponding to the winning-probability after the change, and the color of the image area of each the unwinning number becomes a color corresponding to the odds data after the change, on the large-sized display 2 (S24). As a result, the roulette image, in which the sizes of image areas of the respective unwinning numbers are changed into mutually different sizes, is displayed on the large-sized display 2 as shown in FIG. 10.

By executing the winning-probability changing process as described above, a player checks the winning numbers up until this point in time by looking at the bingo card image displayed on the touch panel 11, and touches an image of the winning-desired number, which the player desires to win, such as numbers necessary to establish BINGO, whereby the winning-probability of the winning-desired number can be increased.

Also, in the embodiment, the winning-probability of each of the numbers clan be understood based on the sizes of the image areas in the roulette image. And, if when a player touches the image of a winning-desired number on the touch panel 11, which the player desires to win, so that the winning-probability of winning-desired number is increased, the size of the image area corresponding to the winning-desired number on the roulette image is widened. Therefore, the player can intuitively understand that the winning-probability of the number that the player desires to win has been increased. Also, simultaneously, since the color corresponding to the odds data is changed after the color of the image area corresponding to the winning-desired number on the roulette image changes, the player can intuitively know the allotment quantity after the change.

In addition, in the embodiment, whenever the winning-desired number that a player desires to win is drawn, the attack gauge of the attack-gauge-display-column 11*f*; which is displayed at the left upper part of the game screen of the touch panel 11, is increased. If the attack gauge becomes full, an attack-operation is enabled. In detail, where the attack gauge has been become full, whenever the attack button 12 is pressed after the player touches the winning-desired number image on the touch panel 11 when executing the winning-probability changing process (attack-operation), the winning-desired number information is accepted by the game progression control unit 101. That is, the game progression control unit 101 accepts a plurality of pieces of winning-desired number information with respect to the same number from one station 10 during one-time winning-probability changing process. Thereby, the player who is able to carry out an attack-operation can greatly increase the winning-probability of the winning-desired number that the player desires to win, by pressing the attack button 12 when executing a winning-probability changing process. However, such a condition of carrying out an attack-operation other than the condition that the attack gauge becomes full may be added. For example, such a condition may be added, in which the flag showing the state of waiting for the last number of the predetermined bingo array(s) is, set with respect to the array information corresponding to the bingo card image displayed on the touch panel 11 corresponding to the station 10.

In the embodiment, if a player touches a winning-desired number on the touch panel 11 when the fourth, the sixth, the eighth, and the tenth drawings are finished, the winning-desired number information is outputted from the input controller 17 and is accepted by the game progression control unit 101, wherein the winning-probability of the winning-desired number is increased. The after-changed winning-probability is maintained until the next winning-probability changing process is executed, and the winning-probability is reset when the next winning-probability changing process is carried out. That is, for example, where the winning-probability of the winning-desired number is increased when the fourth drawing is finished, the fifth and the six drawings are executed in a state where the winning-probability of the winning-desired number is kept high. However, the winning-probability of each of all the unwinning numbers is evenly reset when the sixth drawing is finished. This is the same in a case where the winning-probability is increased when the sixth, the eighth, and the tenth drawings are finished.

FIG. 11 is a flowchart showing a flow of an attack process.

The attack process is commenced after the fourth and subsequent drawings are finished. If the winning-desired number the winning-probability of which has been increased is drawn by the drawing (S31), the game progression control unit 101 executes a process of increasing the attack data, which is stored in the attack-gauge-storage-area of the RAM 7, by a predetermined amount (S32). Also, the game progression control unit 101 outputs a displaying instruction to the station displaying unit 103, and increases the attack gauge of the attack-gauge-display-column 11*f* on the game screen of the touch panel 11.

After that, when the fourth, the sixth, the eighth and the tenth drawings are finished, that is, when a commencement condition of the winning-probability changing process is satisfied (S33), the game progression control unit 101 decides whether or not the attack gauge data stored in the attack gauge storage area of the RAM 7 reaches a predetermined amount (that is, becomes full) (S34). When it is decided that the attack gauge is not full, it is possible to increase the winning-probability of the winning-desired number by the normal winning-probability changing process described above (S20). On the other hand, when it is decided that the attack gauge is full, the game progression control unit 101 permits an attack-operation at the corresponding station 10 (S35). In detail, the game progression control unit 101 outputs to the station displaying unit 103 a displaying instruction to display a description image for urging the player to touch the number that the player desires to win, and thereafter to press the attack button 12. Thereby, the station displaying unit 103 displays the description image on the game screen of the touch panel 11. The player who looked at the description image presses the attack button 12 (S36) as much as the player likes within the time limit (S38), after selecting one of the unwinning numbers on the number image of the bingo image displayed on the game screen of the touch panel 11 and touching the number. If so, the winning-desired number information showing the touched number are outputted (S37) from the input controller 17 as times as the attack button 12 is pressed, and the winning-desired number information are accepted by the game progression control unit 101.

When the game progression control unit 101, which is a fluctuation amount determination unit, accepts the winning-desired number information, it functions as fluctuation amount determination means. And the game progression control unit 101 determines the amount of increase in the winning-probability of the winning-desired number in accordance with a predetermined determination condition of fluctuation amount. The condition is that the amount of increase in the winning-probability of the winning-desired number, which the player playing at the station of the outputting source desires to win, becomes gradually greater in line with an increase in the number of times of outputting the winning-desired number information. The winning-probability changing unit 106 changes the winning-probability data so that the winning-probability of the winning-desired number is increased equivalent to the amount of increase. In the embodiment, although one station 10 outputs only one piece of winning-desired number information in the normal winning-probability changing process, a plurality of pieces of winning-desired number information can be outputted with respect to the same winning-desired number from one station 10 if an attack-operation is carried out. Therefore, according to the attack process, the winning-probability of the winning-desired number can be increased to a large degree in comparison with a case of the normal winning-probability changing process.

Further, in the embodiment, although the winning-probability of a winning-desired number is only increased by pressing the attack button 12 when executing an attack process, it may be devised that a bet is added when pressing the attack button 12. A flowchart in this case is shown in FIG. 12.

As shown in FIG. 12, if a player presses the attack button 12 at the attack process (S36), winning-desired number information is outputted (S37) and an additional bet signal is outputted (S39). The additional bet signal is transmitted to the game progression control unit 101. The game progression control unit 101, which is a bet accepting unit, functions as bet accepting means and accepts the bet, and outputs a bet instruction to the token management device 18. Thereby, the token management device 18 carries out a process of subtracting credits equivalent to the predetermined number (for example one) of tokens and adding the credits equivalent to the number to the bet data. Thus, in the embodiment, the game progression control unit 101, which is a fluctuation amount determination unit, functions as fluctuation amount determination means. And the game progression control unit 101 determines the amount of increase in the winning-probability of the winning-desired number in accordance with a predetermined determination condition of fluctuation amount. The condition is that the amount of increase in the winning-probability of the winning-desired number, which the player playing at the station of the transmission source desires to win, becomes gradually greater in line with an increase in the number of credits accepted as the bet. The winning-probability changing unit 106 changes the winning-probability data so that the winning-probability of the winning-desired number is increased equivalent to the amount of increase.

Generally, the larger the bet credit amount becomes, the greater the risk of losing credit is increased. In the embodiment, since the risk of losing more credits is increased in line with an increase in the winning-probability of the winning-desired number, a more favorable game balance is obtained in comparison with a case of merely increasing the winning-probability of a winning-desired number.

Also, although the attack-operation described above can be carried out after the fourth, the sixth, the eighth or the tenth drawing is finished, it may be devised that the attack-operation is carried out after the bingo card image is displayed on the touch panel 11 of the station 10 before providing a notification of the winning number determined by the first drawing. This is because there are cases where, even before providing a notification of the first winning number, a player who looked at the bingo card image desires winning of a number disposed at an advantageous position for BINGO establishment or disposed at the player favorite position.

Also, in the example as shown in FIG. 12, winning-probability is increased with respect to a winning-desired number that a player who has a larger additional bet amount desires winning. However, it may be devised that the winning-probability is increased with respect to the winning-desired number that a player who has a larger bet amount bet when a bingo game is commenced desires winning. A flowchart in this case is shown in FIG. 13.

As shown in FIG. 13, if the game progression control unit 101, which is a fluctuation amount determination unit, accepts the winning-desired number information (S21), it functions as fluctuation amount determination means. And the game progression control unit 101 determines the amount of increase in the winning-probability of the winning-desired number in accordance with a predetermined determination condition of fluctuation amount (S25). The condition is that the amount of increase in winning-probability of a winning-desired number becomes gradually greater in line with an increase in winning-probability of the winning-desired number, which has been bet more quantity of credits at the station that is the transmission source of the winning-desired number information. In detail, the game progression control unit 101 accepted the winning-desired number information receives a quantity of credits having been bet at the station that is the transmission source of the winning-desired number information from the token management device 18. And, the game progression control unit 101 determines amount of increase in the winning-probability of the winning-desired number based on the received quantity of credits so that the winning-probability of the winning-desired number is increased equivalent to the quantity of credits. After that, when the game progression control unit 101 outputs the winning-probability changing instruction to the winning-probability changing unit 106, the winning-probability changing unit 106 changes the winning-probability data stored in the winning-probability-storage-area of the RAM 7 so that the winning-probability of the winning-desired number is increased equivalent to the amount of increase corresponding to the winning-probability changing instruction (S22).

In the example as shown in FIG. 13, the degree of increasing the winning-probability by one piece of the winning-desired number information is changed based on the quantity of credits having been bet at the station 10 that is the transmission source of the winning-desired number information. That is, a player who has a higher risk of losing credits can further increase the winning-probability of the winning-desired number. Therefore, a further favorable game balance is obtained in comparison with a case of merely increasing the winning-probability of the winning-desired number.

Next, a description is given of another example that the degree of increasing the winning-probability by one piece of the winning-desired number information is changed.

FIG. 14 is a flowchart showing a flow of a winning-probability changing process according to present example.

When the game progression control unit 101 accepts the winning-desired number information (S21), it decides whether or not the flag showing the state of waiting for the last number of the predetermined bingo array(s) is set with respect to the array information corresponding to the station 10 that is the transmission source of the winning-desired number information (S26). If the flag is not set, the game progression control unit 101, which is a fluctuation amount determination unit, functions as fluctuation amount determination means and determines the amount of increase in the winning-probability of the winning-desired number to a small amount of increase (S27). On the other hand, if the flag has been set, the game progression control unit 101, which is a fluctuation amount determination unit, functions as fluctuation amount determination means and determines the amount of increase in the winning-probability of the winning-desired number to a large amount of increase (S28). That is, the game progression control unit 101 determines the amount of increase in the winning-probability of the winning-desired number in accordance with a predetermined determination condition of fluctuation amount, in which the condition is that the amount of increase in the winning-probability of the winning-desired number is different between in the state of waiting for the last number of the predetermined bingo array(s) and in not the state. After that, when the game progression control unit 101 outputs the winning-probability changing instruction to the winning-probability changing unit 106, the winning-probability changing unit 106 changes the winning-probability data stored in the winning-probability-storage-area of the RAM 7 so that the winning-probability of the winning-desired number is increased equivalent to the amount of increase corresponding to the winning-probability changing instruction (S22).

In the example as shown in FIG. 14, the degree of increasing the winning-probability by one piece of the winning-desired number information is changed by whether or not the flag is set with respect to the array information corresponding to the station 10 that is the transmission source of the winning-desired number information. In detail, a player who is in the state of waiting for the last number of the predetermined bingo array(s) can further increase the winning-probability of the winning-desired number. Therefore, the advantages of players differ from each other with respect to the winning-probability of the winning-desired number based on whether or not the numbers are in the state, wherein the game attractiveness is improved.

Also, in the above description, a case where the present invention is applied to a bingo game machine being a token game machine as a game apparatus for business use was described as an example. However, the present invention may be applied not only to a bingo game machine but also other game apparatuses such as a game machine for home use, a coin type game machine, etc. utilizing the computer drawing, or an apparatus utilizing the computer drawing other than game device.

Further, in the above description, a case where winning-probability of the winning desired number that the player desires to win is changed was described as an example. However, winning-probability of a winning desired number that the player desires to not win may be changed.

In addition, in the above description, a game apparatus in which a plurality of players (seven players at maximum) can join at the same time was described as an example. The present invention may be applicable to a game apparatus in which a single player can enjoy.

Further, it is possible that a plurality of bingo game machines described above are connected to each other via a network, wherein bingo games using the same result of drawings can be carried out at the plurality of bingo game machines. In this case, since winning-probability of the unwinning numbers is changed based on winning-desired number information by seven or more player, the game attractiveness by changing winning-probability is further improved.

In addition, a part of the configuration of the above-described bingo game machine may be provided at a communication terminal such as a telephone set equipped with a data communication feature, which a player has. Also, in this case, it is necessary that the bingo game machine is provided with a communication unit operating as communication means to enable data transmission between the bingo game machine and the communication terminal via a network.

The detailed example thereof may be an example in which the roulette image (winning-probability image) displayed on the large-sized display 2 described above is displayed at the displaying unit operating as displaying means of the communication terminal. In this example, data to display the roulette image on the displaying unit of the communication terminal may be transmitted from the above-described communication unit to the communication terminal via the network. And, when the winning-probability changing unit 106 changes the winning-probability data, data for changing the roulette image displayed on the displaying unit of the communication terminal to that in accordance with the winning-probability data after the change may be transmitted from the communication unit to the communication terminal via the network. Thereby, the player can check the roulette image by looking at the displaying unit of the communication terminal that the player has, without looking at the large-sized display 2. In addition, if all the images displayed on the large-sized display 2 are displayed on the displaying unit of the communication terminal, there is no need to provide such a large-sized display 2.

As another detailed example, such an example in which operations for selecting desired numbers that a player desires to win are executed by not using the touch panel 11 of the station 10 but using the operation unit operating as operating means of the communication terminal may be described. In this example, for example, the winning-desired number information may be transmitted from the communication terminal when a player selects his or her desired number by operating the operation unit of the communication terminal. And, when the communication unit receives the winning-desired number information, the game progression control unit 101 determines the winning-desired number that the player desires to win, based on the received winning-desired number information.

As still another example, such an example may be described, in which all of the components equipped in the station 10 are provided in a communication terminal. In this case, a player is able to play a game using the communication terminal, which the player has, without using the station 10. However, in this case, since it is difficult that the communication terminal has a mechanism for transfer of tokens such as the token input port 13 and the token receiving port 14, bets and allotment payouts may be carried out by not using tokens but using credit data.

The invention claimed is:

1. A drawing machine for determining a winning-object from a plurality of drawing-objects, comprising:

a winning-probability data storage unit for storing winning-probability data showing respective winning-probabilities of the plurality of drawing-objects;

a drawing unit for carrying out drawings in accordance with the winning-probabilities of the drawing-objects determined by the winning-probability data stored in the winning-probability data storage unit and determining a winning-object from the plurality of drawing-objects;

a winning-probability data changing unit for changing the winning-probability data stored in the winning-probability data storage unit;

a winning-probability image displaying unit for displaying a winning-probability image showing the winning-probabilities of the drawing-objects determined by the winning-probability data stored in the winning-probability data storage unit, wherein an image of a winning object determined by a previous drawing is excluded from the winning-probability image showing the winning-probabilities of the drawing-objects; and a winning-probability displaying control unit for changing the winning-probability image displayed on the winning-probability image displaying unit, when the winning-probability data changing unit changes the winning-probability data, so as to correspond to the changed winning-probability data.

2. The drawing machine according to claim 1, wherein the winning-probability image has image areas corresponding to the respective drawing-objects, and the winning-probability of each of the drawing-objects is represented according to a size of the image area.

3. The drawing machine according to claim 1, wherein in the respective drawings carried out by the drawing unit within a predetermined term, a winning-object is determined from a rest of the drawing-objects which is obtained by excluding the winning-objects determined by the drawings already carried out within the predetermined term, from the plurality of drawing-objects, and the winning-probability data changing unit determines the respective winning-probabilities of the rest of the drawing-objects in intervals between the respective drawings carried out by the drawing unit within the predetermined term, and changes the winning-probability data so that the winning-probabilities of the rest of the drawing-objects become the determined winning-probabilities, respectively.

4. A game apparatus, comprising: the drawing machine according to any one of claims 1 through 3; and a game control unit for controlling progression of a game using a result of the drawing executed by the drawing machine.

5. The game apparatus according to claim 4, further comprising: a bet accepting unit for accepting a bet for a bet-object; and an allotment payout unit for paying out allotment, wherein the game control unit decides whether a predetermined payout condition is met or not, based on the result of the drawings by the drawing machine, and when the game control unit decides that the predetermined payout condition is met, the game control unit controls the allotment payout unit to pay out a quantity of allotment corresponding to a quantity of the bet-object accepted by the bet accepting unit.

6. The game apparatus according to claim 4, wherein the game control unit controls so that the quantity of allotment paid out by the allotment payout unit decreases when the winning-probability data is increased by the winning-probability data changing unit of the drawing machine, and the quantity of allotment paid out by the allotment payout unit increases when the winning-probability data is decreased by the winning-probability data changing unit.

7. The game apparatus according to claim 6, comprising:

an allotment quantity determination data storage unit for storing, for each of the plurality of drawing-objects, an allotment quantity, determination data for determining the quantity of allotment paid out when the corresponding drawing-object is a winning-object determined next by the drawing unit so that the predetermined payout condition is met; and an allotment quantity image displaying unit for displaying allotment quantity images showing allotment quantities of the respective drawing-objects, the allotment quantities being determined based on the allotment quantity determination data stored in the allotment quantity determination data storage unit, wherein the game control unit, when the drawing unit determines a winning-object so that a predetermined payout condition is met, controls the allotment payout unit to pay out the quantity of allotment determined by the allotment quantity determination data corresponding to the winning-object, which is stored in the allotment quantity determination data storage unit, the game control unit executes a control so that the payout ratio becomes substantially fixed before and after the winning-probability data changing unit changes the winning-probability data by changing allotment quantity determination data stored in the allotment quantity determination data storage unit, and when the allotment quantity determination data is changed, the game control unit executes a display control in order to change the allotment quantity image displayed on the allotment quantity image displaying unit to that in accordance with allotment quantity determination data after the change.

8. The game apparatus according to claim 7, wherein the allotment quantity image has image areas corresponding to the respective drawing-objects, and a difference of colors of the respective image areas corresponds to a difference of the allotment quantities of the respective drawing-objects.

9. The game apparatus according to claim 5, comprising: an array image displaying unit for displaying an array image in which a plurality of drawing-object-images corresponding to part or all of the plurality of drawing-objects are arrayed; and a winning-object storage unit for storing the winning-objects already determined by the drawing unit of the drawing machine within a term in which a plurality of times of the drawings are carried out by using the drawing machine, wherein the game control unit controls the allotment payout unit to pay out the allotment if a predetermined payout condition is met, the condition being defined so that the plurality of winning-objects stored in the winning-object storage unit form a predetermined combination, and the predetermined combination is a combination of winning-objects in which an array of the drawing-object-images in the array image corresponding to a plurality of winning-objects stored in the winning-object storage unit becomes a predetermined array.

10. The game apparatus according to claim 6, comprising: an array image displaying unit for displaying an array image in which a plurality of drawing-object-images corresponding to part or all of the plurality of drawing-objects are arrayed; and a winning-object storage unit for storing the winning-objects already determined by the drawing unit of the drawing machine within a term in which a plurality of times of the drawings are carried out by using the drawing machine, wherein the game control unit controls the allotment payout unit to pay out the allotment if a predetermined payout condition is met, the condition being defined so that the plurality of winning-objects stored in the winning-object storage unit form a predetermined combination, and the predetermined combination is a combination of winning-objects in which an array of the drawing-object-images in the array image corresponding to a plurality of winning-objects stored in the winning-object storage unit has become a predetermined array.

11. The game apparatus according to claim 7, comprising: an array image displaying unit for, displaying an array image in which a plurality of drawing-object-images corresponding to part or all of the plurality of drawing-objects are arrayed; and a winning-object storage unit for storing the winning-objects already determined by the drawing unit of the drawing machine within a term in which a plurality of times of the drawings are carried out by using the drawing machine, wherein the game control unit controls the allotment payout unit to pay out the allotment if a predetermined payout condition is met, the condition being defined so that the plurality of winning-objects stored in the winning-object storage unit form a predetermined combination, and the predetermined combination is a combination of winning-objects in which an array of the drawing-object-images in the array image corresponding to a plurality of winning-objects stored in the winning-object storage unit has become a predetermined array.

* * * * *